US007018438B2

(12) United States Patent
Duggan

(10) Patent No.: US 7,018,438 B2
(45) Date of Patent: Mar. 28, 2006

(54) FILTERING SYSTEM

(75) Inventor: Daniel J. Duggan, Grafton, OH (US)

(73) Assignee: HMI Industries, Inc., Seven Hills, OH (US)

( * ) Notice: Subject to any disclaimer, the term of this patent is extended or adjusted under 35 U.S.C. 154(b) by 732 days.

(21) Appl. No.: 10/113,579

(22) Filed: Mar. 29, 2002

(65) Prior Publication Data

US 2003/0182756 A1 Oct. 2, 2003

(51) Int. Cl.
*B01D 29/15* (2006.01)

(52) U.S. Cl. ..... 55/418; 55/429; 55/467; 55/502; 55/507; 55/521; 15/353

(58) Field of Classification Search ..... 55/337, 55/428, 429, 459.1, 467, 502, 505, 507, 521, 55/418; 15/350, 353
See application file for complete search history.

(56) References Cited

U.S. PATENT DOCUMENTS

| | | | | |
|---|---|---|---|---|
| 1,921,085 | A | 8/1933 | Korittke | |
| 2,003,833 | A | 3/1936 | Kent | |
| 2,139,736 | A | 12/1938 | Durham | |
| 2,242,278 | A | 5/1941 | Yonkers, Jr. | |
| 2,394,923 | A | 2/1946 | Little | |
| 2,608,268 | A | 8/1952 | Gerber | |
| 2,627,936 | A | 2/1953 | Martinet | |
| 2,627,937 | A | 2/1953 | Martinet | |
| 2,763,886 | A | 9/1956 | Brown, Jr. et al. | |
| 3,343,344 | A | 9/1967 | Fairaizl et al. | |
| 3,545,181 | A | 12/1970 | Young | |
| 3,724,181 | A | 4/1973 | Benson, Jr. | |
| 3,804,942 | A | 4/1974 | Kato et al. | |
| 3,853,512 | A | 12/1974 | Hayashi | |
| 3,870,495 | A | 3/1975 | Dixson et al. | |
| 3,925,043 | A | 12/1975 | Matrone et al. | |
| 3,953,184 | A | 4/1976 | Stockford et al. | |
| 3,966,597 | A | 6/1976 | Omori et al. | |
| 3,998,916 | A | 12/1976 | van Turnhout | |
| 4,121,916 | A | 10/1978 | Fricke | |
| 4,229,193 | A | 10/1980 | Miller | |
| 4,276,070 | A * | 6/1981 | Hug | 55/429 |
| 4,339,250 | A | 7/1982 | Thut | |
| 4,365,980 | A | 12/1982 | Culbert et al. | |
| 4,377,399 | A | 3/1983 | Bryson | |

(Continued)

FOREIGN PATENT DOCUMENTS

DE 27 11 111 A1 8/1979

(Continued)

OTHER PUBLICATIONS

Article entitled *3M Brand Substrate Blown Microfiber Filter Media*, from brochure entitled *3M Filtration Products*, 1994.

*Primary Examiner*—Robert A. Hopkins
(74) *Attorney, Agent, or Firm*—Fay Sharpe Fagan Minnich & McKee; Brian E. Turung; Robert V. Vickers

(57) ABSTRACT

A vacuum cleaner having a reduced velocity chamber with a high velocity air inlet, an electric motor, a rotary blade driven by the motor to create a vacuum in the chamber, an outlet for exhausting air from the chamber, which air flows in a selected path from the air inlet, through the chamber and out the air exhaust outlet, a disposable porous sheet filter layer in the chamber for removing large solid particles from the air, and a disposable noncollapsible filter liner in the chamber and connected to the filter.

85 Claims, 7 Drawing Sheets

U.S. PATENT DOCUMENTS 4,378,234 A 3/1983 Suzuki et al.
4,385,911 A 5/1983 Popeil et al.
4,477,270 A 10/1984 Tauch
4,504,290 A 3/1985 Pontius
4,507,819 A 4/1985 Martinec
4,514,197 A 4/1985 Armbruster
4,531,956 A 7/1985 Howorth
4,627,862 A 12/1986 Frei et al.
4,629,482 A 12/1986 Davis
4,650,505 A 3/1987 Magdelain
4,687,579 A 8/1987 Bergman
4,687,697 A 8/1987 Cambo et al.
4,702,753 A 10/1987 Kowalczyk
4,737,173 A 4/1988 Kudirka et al.
4,749,390 A 6/1988 Burnett et al.
4,750,924 A 6/1988 Potter
4,784,676 A 11/1988 Hale
4,810,269 A 3/1989 Stackhouse et al.
4,874,659 A 10/1989 Ando et al.
4,886,527 A 12/1989 Föttinger et al.
4,900,344 A 2/1990 Lansing
4,902,306 A 2/1990 Burnett et al.
4,909,815 A 3/1990 Meyer
4,917,942 A 4/1990 Winters
4,921,510 A 5/1990 Plooy
4,927,437 A 5/1990 Richerson
5,037,455 A 8/1991 Scheineson et al.
5,090,976 A * 2/1992 Dyson ..... 55/337
5,108,470 A 4/1992 Pick
5,141,706 A 8/1992 Clark
5,188,646 A 2/1993 Nolen, Jr.
5,221,573 A 6/1993 Baigas, Jr.
5,240,478 A 8/1993 Messina
5,248,323 A 9/1993 Stevenson
5,287,591 A 2/1994 Rench et al.
5,288,298 A 2/1994 Aston
5,290,330 A 3/1994 Tepper et al.
5,306,534 A 4/1994 Bosses
5,307,538 A 5/1994 Rench et al.
5,350,620 A 9/1994 Sundet et al.
5,358,443 A 10/1994 Mitchell et al.
5,399,319 A 3/1995 Schoenberger et al.
5,435,817 A 7/1995 Davis et al.
5,443,625 A 8/1995 Schaffhausen
5,478,377 A 12/1995 Scavnicky et al.
5,498,272 A 3/1996 Leon
5,515,573 A 5/1996 Frey
5,593,479 A 1/1997 Frey et al.
5,603,741 A 2/1997 Frey
5,641,343 A 6/1997 Frey
5,647,881 A 7/1997 Zhang et al.
5,651,811 A 7/1997 Frey et al.
5,658,362 A 8/1997 Frey
5,837,020 A 11/1998 Cartellone
5,840,103 A 11/1998 Dyson
5,874,052 A 2/1999 Holland
5,931,991 A 8/1999 Leon
6,003,196 A 12/1999 Wright et al.
6,010,550 A 1/2000 Song
6,090,184 A 7/2000 Cartellone
6,197,096 B1 3/2001 Cartellone
6,243,915 B1 6/2001 Nakai et al.
6,488,744 B1 * 12/2002 Cartellone ..... 95/268

FOREIGN PATENT DOCUMENTS

DE 42 40 172 A1 6/1994
FR 2 653 354 A1 4/1991
JP 2-187114 A2 7/1990
JP 4-197460 A2 7/1992
JP 8-66341 A2 3/1996
JP 11-309204 A2 11/1999

* cited by examiner

FILTERING SYSTEM

INCORPORATION BY REFERENCE

U.S. Pat. Nos. 3,343,344; 4,229,193; 4,507,819; 4,921,510; 5,248,323; 5,515,573; 5,593,479; 5,603,741; 5,641,343; 5,651,811; 5,658,362; 5,837,020; 6,090,184; 6,197,096; and Des. 432,746, and U.S. patent application Ser. No. 09/809,841 filed Mar. 19, 2001, are incorporated herein as background information regarding the type of cleaning systems to which the present invention is particularly applicable, and to preclude the necessity of repeating structural details relating to such cleaning systems. Several of these patents and the patent application illustrate canister type vacuum cleaners having a low velocity receptacle or chamber into which is placed a conical filter sheet formed from non-woven cellulose fiber placed over a downwardly extending support structure for the purpose of removing particulate material from the air flowing through the vacuum cleaner. The rigid perforated conical support structure or member holds the filter sheet in its conical configuration. The support member and filter sheet are typically mounted together with the layer covering the rigid support member. Within the conical support member, there is typically provided a generally flat disc-shaped cellulose filter sheet for further removal of particulate solids as the solids pass with the air from the canister through the conical filter sheet and through the disc to the outlet or exhaust of the vacuum cleaner.

The present invention relates to the art of air filter systems and, more particularly, to an improved vacuum cleaner employing a novel filter system. The invention is particularly applicable for a canister type vacuum cleaner and will be described with particular reference thereto; however, the invention has much broader applications and may be used to filter air in other types of vacuum cleaners and/or air filtering systems by employing the novel filter system and filtering method as contemplated by the present invention.

BACKGROUND OF THE INVENTION

As more people populate urban environments, there is an increasing need to provide a clean air environment at home and in the work place. In urban areas, where pollution levels sometimes exceed maximum values set by the EPA, the need for a clean air environment becomes even more apparent. In view of the hazards these polluted environments pose, the public has demanded a means for removing pollutants from the environment to provide a healthy environment for both living and working. Furthermore, many particles in the air can act as irritants and/or increase or aggravate a person's allergies. Airborne pollutants can also contribute to respiratory infections and/or illnesses which can be discomforting and/or hazardous to individuals with respiratory problems. Particles in the air can also create problems such as burning eyes, nose and/or throat irritation; cause or contribute to headaches and dizziness; and/or cause and/or contribute to coughing and sneezing. Furthermore, these particles can include various types of spores, dust mites, micro-organisms (e.g., bacteria, viruses, etc), allergens, and/or other types of harmful particles which may cause illness and/or infection to a person; and/or induce and/or aggravate respiratory ailments (asthma, RSV, lung cancer, etc.).

In an effort to reduce the number of particles in the air and/or other environments, many homes, offices, and buildings have incorporated a central filtering system to remove particles entrained in the air. Unfortunately, these systems are very expensive and/or do not remove many of the small particles which can be the most hazardous and/or irritable to persons (e.g., spores, allergens (e.g., pollen, smoke, etc.), micro-organisms (e.g. bacteria, viruses, etc.), dust mites, asbestos, metals, harmful and/or irritating chemicals, etc.). Typically, these filtering systems only remove about 300,000 particles out of about 20 million particles which flow into the filter medium. The small particles, which make up a majority of the particles in the air, freely pass through these conventional filter systems and are recirculated through the home and/or office.

In an effort to remove particles from a home and/or office environment, and reduce the amount of particles recirculated during the vacuuming of the home and/or office, two design strategies have been developed by Assignee, one relating to the design of the vacuum cleaner and the second relating to the design of the filters. Assignee has found that canister type vacuum cleaners provide superior cleaning efficiencies as compared with upright vacuum cleaners. One particular canister type vacuum cleaner is illustrated in U.S. Pat. No. 5,248,323, which is incorporated herein by reference. The canister type vacuum cleaner includes a reduced or low velocity chamber with a high velocity air inlet. Air is drawn into the low velocity chamber by an electric motor which drives a rotary fan. The rotary fan creates a vacuum in the low velocity chamber to draw air laden with particulate material through the chamber and to blow the filtered air through an outlet in the motor housing as exhausted cleaned air. Canister type vacuum cleaners normally include a cylindrical or a conical cellulose filter extending downwardly into the canister or low velocity chamber. The filter is typically formed of a porous mat to remove dirt and debris carried by the air drawing into the low velocity chamber. The high velocity air drawn into the chamber has entrained large solid particles. The large particles which are brought into the low velocity chamber are swirled or vortexed in a centrifuge configuration with convolutions so that the large particles are extracted by the vortex or cyclonic action of the air in the canister. Thereafter, the air is pulled through the filter toward an upper motor that drives a fan which creates a vacuum in the canister or low velocity chamber. The fan then expels the filtered air outwardly through an exhaust passage, or passages, above the canister. A filter, such as a thin filter disc, is typically provided between the conical filter and the fan to at least partially prevent large particulate material that is inadvertently passed through the cylindrical or conical filter from contacting the fan. The '323 patent discloses the use of an activated charcoal-containing filter to efficiently remove gaseous impurities in the air, such as, but not limited to, paint fumes and other odor creating gases.

The canister type vacuum cleaner, as so far described, though exhibiting improved cleaning efficiencies as compared with upright vacuum cleaners, only removed relatively large particles entrained in the air. Many of the air particles of a size less than 10 microns passed freely through the filter medium and were recirculated in the room. These small particles can act as irritants to an individual, and the recirculation of such particles can increase such irritation to an individual. High density filters can be used to filter out these very small particles in the air; however, high density filters cause large pressure drops through the filter and thus cannot be cost effectively used in standard vacuum cleaners.

The filter system disclosed in U.S. Pat. Nos. 5,593,479 and 5,651,811 addressed the problem of filtering small particles by disclosing a multi-layer filter which included at least one layer of electrically charged fiber material encapsulated between at least two layers of support material. The multi-layer filter effectively removed small particles from the air which penetrated the cellulose fiber layer. The multi-layer filter was a specialized filter developed to remove many of the small particles in the air. Such filters are known as High Efficiency Particle Air Filters, or HEPA filters, which, by government standards, are filters with a minimum efficiency of 99.97%. The industry defines HEPA filters as those which are efficient in removing 99.97% of the airborne particles having the size of 0.3 micron or larger. HEPA filters are commonly used in ultra clean environments such as in a laboratory, in electronic and biologically clean rooms, in hospitals, and the like. HEPA filters have recently been incorporated in air filters for business and/or individual use. The '479 and '811 patents disclosed that an activated charcoal filter could also be used to remove odors from the air.

The multiple filter system disclosed in the '479 and '811 patents was further improved by the filter system disclosed in U.S. Pat. No. 6,090,184. The filter system disclosed in the '184 patent combined an electrically charged fiber material with an activated charcoal filter to simplify the use of the filters in the vacuum cleaner. The combined filter reduced the number of filters to only the standard cellulose filter and the combined gas and small particle filter. The combined filter was designed to exhibit increased filter efficiency without added pressure drop. The efficiencies of standard HEPA filters are all based upon 0.3 micron size particles. Historically, it was believed that particles about 0.3 micron in size were the most difficult to remove from the air. However, particle filtration testing revealed that particles the size of about 0.1 micron are the most difficult to remove from the air. Standard HEPA filters do not efficiently remove such small particles and allow such particles to freely pass through the filter medium. An analysis of these small particles has shown that the particles do not naturally fall out of the air, but instead remain entrained in the air by constantly bouncing off other particles in the air (i.e. Browning effect). These small particles have also been found to deviate from the air flow, thus making such particles even more difficult to remove from the air. The filter disclosed in the '184 patent was designed to remove at least about 99.98% of the particles in the air that were about 0.1 micron or greater in size.

Although Assignee's vacuum cleaners and filter systems effectively and efficiently remove particles entrained in the air, there remained a demand for more efficient vacuum cleaners and more user friendly vacuum cleaners. This demand was effectively addressed in Assignee's U.S. patent application Ser. No. 09/809,841 filed Mar. 19, 2001. In the '841 patent application, a novel filter arrangement and vacuum cleaner design were disclosed which further improved the filtering efficiencies of the vacuum cleaner. In addition, the '841 patent application disclosed a unique vacuum cleaner design that facilitated in the ease of removal and/or replacement of the filter from the vacuum cleaner. Assignee's U.S. patent application Ser. No. 09/809,841 filed Mar. 19, 2001 is incorporated herein by reference.

Even with the significant improvements in filter design and vacuum cleaner design disclosed in Assignee's U.S. patent application Ser. No. 09/809,841 filed Mar. 19, 2001, there remains a need for a vacuum cleaner and vacuum cleaner filter that reduces the amount of particles expelled by the vacuum cleaner during use and which minimizes particle release from the vacuum cleaner filter when the vacuum cleaner filter is changed.

SUMMARY OF THE INVENTION

The present invention relates to an improved air filtering system and, more particularly, to a vacuum cleaner with a novel filter arrangement which allows the vacuum cleaner to efficiently and effectively at least partially remove particles and/or unwanted odors or gases from the environment. The present invention also relates to an improved vacuum cleaner that facilitates in the effective removal of particles and/or unwanted odors or gases from the environment. The invention is particularly directed to an improved filter arrangement used in a cyclonic type vacuum cleaner such as, but not limited to, a canister type vacuum cleaner, to handle a wide variety of particles entrained in the air being drawn through the vacuum cleaner; however, the filter arrangement can be used in other types of vacuum cleaners (e.g. upright vacuum cleaners, non-cyclonic canister vacuum cleaners), and/or in room filtering systems. In essence, the filter arrangement can be used in an environmental air cleaning device as well as a standard vacuum cleaner.

In accordance with the present invention, there is provided an improvement in a vacuum cleaner of the type comprising a reduced or low velocity chamber with a high velocity air inlet, a motor, a rotary device driven by the motor to create a vacuum in the low velocity chamber, an outlet for exhausting air from the low velocity chamber, and a filter arrangement positioned at least partially in the low velocity chamber for removing particles from the air. In one embodiment of the invention, the filter arrangement includes one or more changeable and/or disposable filters. In another and/or alternative embodiment of the invention, at least one of the filters of the filter arrangement at least partially removes particles. In one aspect of this embodiment, the filter arrangement removes a substantial majority of particles of greater than about 10 microns. In another and/or alternative aspect of this embodiment, the filter arrangement removes a substantial amount of particles of about 10 microns or less in size. Such a filter provides significantly cleaner filtered air. Standard filter mediums filter out approximately 300,000 particles out of 20 million particles which flow through the filter medium. Particles which are ten microns or less in size pass freely through standard filter medium. Such particles include, but are not limited to, pollen and/or other allergens, dust mites, bacteria, viruses, etc. The recirculation of these small particles can spread disease, cause and/or aggravate allergic reactions, and/or trigger respiratory problems. In still another and/or alternative embodiment of the invention, the filter arrangement removes a majority of sizes of particles entrained in the air. In a typical vacuuming operation, nearly 20 million particles are directed into the vacuum cleaner. The filter arrangement of the present invention removes at least about 18–19 million of these particles. In one aspect of this embodiment, over 90% of the particles greater than about 2 microns in size are filtered out of the air passing through the improved filter arrangement. In yet another and/or alternative embodiment of the invention, the filter arrangement includes mechanical, electrical (which includes electrostatics) and/or chemical mechanisms to filter out the particles. In still yet another and/or alternative embodiment of the invention, the filter arrangement is designed to at least partially remove odors from the air. In one aspect of this embodiment, the filter arrangement incorporates the use of one or more gas absorbing and/or adsorbing substances to absorb and/or adsorb odors that are drawn into the vacuum cleaner or other type of air cleaner.

In accordance with another and/or alternative aspect of the present invention, the filter arrangement includes one or more particle filters which remove a majority of the particles entrained in the air as the particles pass through the filter arrangement. In one embodiment of the invention, one or more particle filters remove at least about 90% of particles entrained in the air having a size greater than about 10 microns. In one aspect of this embodiment, one or more particle filters remove at least about 95% of particles entrained in the air having a size greater than about 10 microns. In another and/or alternative aspect of this embodiment, one or more particle filters remove at least about 99% of particles entrained in the air having a size greater than about 10 microns. In still another and/or alternative aspect of this embodiment, one or more particle filters remove at least about 99.9% of particles entrained in the air having a size greater than about 10 microns. In another and/or alternative embodiment of the invention, one or more particle filters remove at least about 90% of particles entrained in the air having a size greater than about 5 microns. In one aspect of this embodiment, one or more particle filters remove at least about 95% of particles entrained in the air having a size greater than about 5 microns. In another and/or alternative aspect of this embodiment, one or more particle filters remove at least about 99% of particles entrained in the air having a size greater than about 5 microns. In still another and/or alternative aspect of this embodiment, one or more particle filters remove at least about 99.9% of particles entrained in the air having a size greater than about 5 microns. In still another and/or alternative embodiment of the invention, one or more particle filters remove at least about 90% of particles entrained in the air having a size greater than about 1 micron. In one aspect of this embodiment, one or more particle filters remove at least about 95% of particles entrained in the air having a size greater than about 1 micron. In another and/or alternative aspect of this embodiment, one or more particle filters remove at least about 99% of particles entrained in the air having a size greater than about 1 micron. In still another and/or alternative aspect of this embodiment, one or more particle filters remove at least about 99.9% of particles entrained in the air having a size greater than about 1 micron. In yet another and/or alternative embodiment of the invention, one or more particle filters remove at least about 90% of particles entrained in the air having a size greater than about 0.3 micron. In one aspect of this embodiment, one or more particle filters remove at least about 95% of particles entrained in the air having a size greater than about 0.3 micron. In another and/or alternative aspect of this embodiment, one or more particle filters remove at least about 99% of particles entrained in the air having a size greater than about 0.3 micron. In still another and/or alternative aspect of this embodiment, one or more particle filters remove at least about 99.9% of particles entrained in the air having a size greater than about 0.3 micron. In yet another and/or alternative aspect of this embodiment, one or more particle filters remove at least about 99.97% of particles entrained in the air having a size greater than about 0.3 micron. In still yet another and/or alternative embodiment of the invention, one or more particle filters remove at least about 90% of particles entrained in the air having a size greater than about 0.1 micron. In one aspect of this embodiment, one or more particle filters remove at least about 95% of particles entrained in the air having a size greater than about 0.1 micron. In another and/or alternative aspect of this embodiment, one or more particle filters remove at least about 99% of particles entrained in the air having a size greater than about 0.1 micron. In still another and/or alternative aspect of this embodiment, one or more particle filters remove at least about 99.9% of particles entrained in the air having a size greater than about 0.1 micron. In yet another and/or alternative aspect of this embodiment, one or more particle filters remove at least about 99.97% of particles entrained in the air having a size greater than about 0.1 micron. In still yet another and/or alternative aspect of this embodiment, one or more particle filters remove at least about 99.98% of particles entrained in the air having a size greater than about 0.1 micron. In a further and/or alternative embodiment of the invention, at least one particle filter of the filter arrangement is made of one or more filter layers. In one aspect of this embodiment, at least one particle filter is a single filter made of multiple filter layers. In another and/or alternative aspect of this embodiment, at least one particle filter is a plurality of single layer filters. In still another and/or alternative aspect of this embodiment, at least one particle filter is a plurality of filters, which filters are single layer filters and/or multiple layer filters. In still a further and/or alternative embodiment, at least one particle filter at least partially removes particles from the air mechanically, chemically and/or electrically. In yet a further and/or alternative embodiment, the composition of at least one particle filter includes, but is not limited to, the composition disclosed in U.S. Pat. Nos. 5,248,323; 5,593,479; 5,641,343; 5,651,811; 5,837,020 and 6,090,184, which are incorporated herein by reference. In still yet a further and/or alternative embodiment, the configuration or design of at least one particle filter includes, but is not limited to, the configuration or design disclosed in U.S. Pat. Nos. 5,248,323; 5,593,479; 5,641,343; 5,651,811; 5,837,020 and 6,090,184, which are incorporated herein by reference.

In accordance with still another and/or alternative aspect of the present invention, the filter arrangement includes one or more gas filters to at least partially remove undesired gases and/or odors from the filtered air such as, but not limited to, smoke, fumes, gas contaminants, and/or noxious gases. In one embodiment of the invention, at least one gas filter includes a gas absorbing and/or adsorbing substance. In one aspect of this embodiment, the gas absorbing and/or adsorbing substance includes, but is not limited to, activated carbon, activated charcoal, diatomaceous earth, Fuller's earth, volcanic rock, lava rock, and/or baking soda. In one aspect of this embodiment, the average particle size of the gas absorbing and/or adsorbing substance, when impregnated on and/or in a material, is generally less than about 10 mesh, and typically less than about 100 mesh; however, larger or smaller particles can be used. In another and/or alternative embodiment of the invention, at least one gas filter includes one or more mats, and/or woven and/or non-woven materials impregnated with one or more gas absorbing and/or adsorbing substances. In one aspect of this embodiment, the mat includes a non-woven polyester material. In another and/or alternative aspect of this embodiment, at least one gas filter has a sponge-like texture. In still another and/or alternative aspect of this embodiment, at least one gas filter has a thickness of about 0.001–1 inch. In still anther and/or alternative embodiment, at least one gas filter includes at least one gas absorbing and/or adsorbing substance in the form of a resin and/or granules. In one aspect of this embodiment, the resin and/or granules are contained in an air permeable device such as, but not limited to, a ventilative bag, a ventilative container and/or the like. In yet another and/or alternative embodiment, at least one gas filter includes at least one gas absorbing and/or adsorbing substance impregnated in a textile material. In a still yet another and/or alternative embodiment, at least one gas filter and the least one particle filter are oriented such that the at least one particle filter or filter layer filters particles prior to exposing the filtered air to the at least one gas filter. In a further and/or alternative embodiment, at least one gas filter and at least one particle filter are oriented such that the at least one gas filter or gas filter layer absorbs and/or adsorbs gas prior to exposing the gas filtered air to the at least one particle filter. In still a further and/or alternative embodiment, at least one gas filter filters both particles and gases from the air as the air passes through the gas filter.

In accordance with yet another and/or alternative aspect of the present invention, the filter arrangement includes at least one particle filter that at least partially removes small particles, which particle filter includes at least one section designed to be a high efficiency particle removing section to at least partially remove very small particles from the air passing through the at least one particle filter. This high efficiency particle section can use mechanical and/or electrical (including electrostatic) capture mechanisms to at least partially remove particles entrained in the air. This high efficiency particle section can include one or more layers. If more than one layer is used, the layer can be connected together by a variety of means such as, but not limited to, adhesives, stitching, staples, clamps, melted regions, and/or the like. In one embodiment of the invention, at least one particle filter is pliable so that the high efficiency particle section easily conforms to and/or deforms on a surface such as, but not limited to, when at least one particle filter is subjected to suction. In one aspect of this embodiment, the deformation of at least one particle filter at least partially results in the at least one particle filter having one or more ribs and/or one or more recessed sections between the ribs. In another and/or alternative embodiment of the invention, at least one particle filter is substantially rigid so that the high efficiency particle section substantially does not deform when subjected to suction. In still another and/or alternative embodiment, at least one particle filter is at least partially conical-shaped. In one aspect of this embodiment, at least one particle filter is at least partially conical-shaped prior to being subjected to suction. In another and/or alternative aspect of this embodiment, at least one particle filter is at least partially conical-shaped when subjected to suction.

In accordance with still yet another and/or alternative aspect of the present invention, the filter arrangement includes at least one gas filter having at least one odor removal section for at least partially removing odor and/or gas from the air passing through at least one gas filter. This at least one odor removal section can use chemical, mechanical and/or electrical (including electrostatic) capture mechanisms to at least partially remove odors and/or undesired gases in the air. This at least one odor removal section can include one or more layers. If more than one layer is used, the layer can be connected together by a variety of mechanisms such as, but not limited to, adhesives, stitching, staples, clamps, melted regions, and/or the like. In one embodiment of the invention, at least one gas filter is pliable so that the at least one gas filter easily conforms to and/or deforms on a surface, such as when the at least one gas filter is subjected to suction. In one aspect of this embodiment, the deformation of the at least one gas filter results in the at least one gas filter having one or more ribs and/or one or more recessed sections between the ribs. In another and/or alternative embodiment of the invention, at least one gas filter is substantially rigid so that the odor removal section substantially does not deform when subjected to suction. In still another and/or alternative embodiment, at least one gas filter is at least partially conical-shaped. In one aspect of this embodiment, at least one gas filter is at least partially conical-shaped prior to being subjected to suction. In another and/or alternative aspect of this embodiment, at least one gas filter is at least partially conical-shaped when subjected to suction.

In accordance with a further and/or alternative aspect of the present invention, the filter arrangement includes at least one particle/gas filter for at least partially removing small particles and at least partially removing gases that pass through the at least one particle/gas filter. The at least one particle/gas filter at least partially removes small particles and odors from the air as the air passes through the filter, thus eliminating the need for a separate filter for small particle removal and odor removal. The particle/gas filter is designed to maintain the integrity of the particle/gas filter during operation and to minimize the degree of pressure drop through the at least one particle/gas filter. In one embodiment of the invention, the particle/gas filter includes at least two distinct sections. At least one distinct section of the particle/gas filter is designed to be a high efficiency particle removing section to at least partially remove very small particles from the air passing through the at least one particle/gas filter. This high efficiency particle removing section uses mechanical and/or electrical (including electrostatic) capture mechanisms to at least partially remove particles entrained in the air. This high efficiency particle removing section can include one or more distinct layers. At least one other section of the particle/gas filter is designed to be a gas removal section to at least partially remove unwanted gases from the air. This at least one other section can be designed to also remove particles from the air. This at least one other section uses electrical (including electrostatic), mechanical and/or chemical capture mechanisms to remove gases and/or particles from the air. This at least one other section can be comprised of one or more layers. In one embodiment of the invention, the two different sections of the at least one particle/gas filter are connected together. In one aspect of this embodiment, the different sections are connected together by various mechanisms such as, but not limited to, adhesives, stitching, staples, clamps, melted regions, and/or the like. In one specific design, at least two of the different sections are at least partially connected together by a hot melt adhesive. In another and/or alternative embodiment of the invention, at least one section of the particle/gas filter is pliable so that the at least one section easily conforms to and/or deforms on a surface, such as when the at least one section is subjected to suction. In still another and/or alternative embodiment of the invention, at least one section of the particle/gas filter is rigid or semi-rigid so as to resist being deformed, especially when exposed to suction. In yet another and/or alternative embodiment of the invention, the orientation of one or more of the different filter sections in the at least one particle/gas filter is such that the particle/gas filter at least partially filters particles prior to exposing the filtered air to at least one gas absorbing and/or adsorbing substance in at least one other filter section. In still yet another and/or alternative embodiment of the invention, the orientation of one or more of the different filter sections in the at least one particle/gas filter is such that the particle/gas filter at least partially absorbs and/or adsorbs gas prior to exposing the filtered air to at least one particle filtering section. In a further and/or alternative embodiment of the invention, at least one particle/gas filter includes a single sections that is designed to be a high efficiency particle removing section to at least partially remove very small particles from the air passing through the at least one particle/gas filter and a gas removal section to at least partially remove unwanted gases from the air. This single section uses mechanical and/or electrical (including electrostatic) capture mechanisms to at least partially remove particles entrained in the air, and electrical (including electrostatic), mechanical and/or chemical capture mechanisms to remove gases and/or particles from the air.

In accordance with still a further and/or alternative aspect of the present invention, the filter arrangement includes a filter that has a support material and fiber material. In one embodiment of the invention, the fiber material is an electrically charged material that is adapted to attract particles to the fibers as particle-entrained air passes adjacent the fibers. In one aspect of the embodiment, the fiber material forms at least one filter layer. In another and/or alternative aspect of this embodiment, the fiber material is at least partially a non-woven material. In still another and/or alternative aspect of this embodiment, at least one layer of the fiber material has a weight of about 30–180 gm/m$^2$. In yet another and/or alternative embodiment of the invention, the support material is a durable material used to at least partially maintain the integrity of the fiber material. In one aspect of this embodiment, the support material at least partially supports and maintains the fiber material in position during the air filtration process. In another and/or alternative aspect of this embodiment, the support material is at least partially a woven material such as, but not limited to, cotton, nylon, rayon, and/or polyester. In still another and/or alternative aspect of this embodiment, the support material at least partially encapsulates the fiber material. In another and/or alternative embodiment of the invention, at least one layer of support material and at least one layer of fiber material are connected together. In one aspect of this embodiment, the at least one layer of support material and at least one layer of fiber material are connected together by an adhesive, stitching, staples, clamps, melted regions, and/or the like.

In accordance with yet a is and/or alternative aspect of the present invention, a disposable filter is used to at least partially remove large particles entrained in the air. The cellulose filter can be used alone or in combination with one or more other filters. In one embodiment, the cellulose filter is positioned in the air path such that the particle-entrained air passes through the cellulose filter prior to the air contacting a filter designed to remove very small particles and/or gas. The use of the cellulose filter enhances the life of the one or more other filters in the filter arrangement.

In accordance with still yet a further and/or alternative aspect of the present invention, one or more filters in the filter arrangement are cylindrical, conical or semi-conical in shape to increase the surface area of the one or more filters, thereby providing increased particle removal efficiencies. As can be appreciated, one or more filters can have a variety of other shapes such as, but not limited to, disk-shaped, square-shaped, rectangular-shaped, oval-shaped, etc.

In accordance with another and/or alternative aspect of the present invention, the filter arrangement at least partially minimizes the degree of pressure drop as the air passes through the filter arrangement. The relatively low pressure drop through the filter arrangement enables the filter arrangement to be used in vacuum cleaners such as, but not limited to, canister type vacuum cleaners, or in various other types of air filter systems. In addition, the lower pressure drop allows the vacuum cleaner or other type of air cleaner to use a smaller motor so that the vacuum cleaner or other type of air cleaner can have a more compact and portable design, utilize less energy, and/or a generate less noise.

In accordance with still another and/or alternative aspect of the present invention, one or more filters of the filter arrangement include one or more tabs, loops or the like, to facilitate the ease in which the one or more filter can be positioned in and/or removed from the vacuum cleaner or other type of air cleaner. The tabs, loops, etc. can also be used as an indicator for the proper position of the one or more filters in the vacuum cleaner or other type of air cleaner, and/or can include information about the one or more filters.

In accordance with yet another and/or alternative aspect of the present invention, the motor of the vacuum cleaner is at least partially located within a motor housing to draw air through an air intake and into the low velocity chamber of the vacuum cleaner, through one or more filters of the filter arrangement, and to expel the filtered air out through the air exhaust. In one embodiment of the invention, the motor includes an electric motor which drives a blade that creates a vacuum in the low velocity chamber, which in turn results in air being drawn into the air intake and through the one or more filters of the filter arrangement. In another and/or alternative embodiment of the invention, one or more filters of the filter arrangement are disposed between the air intake and the low velocity chamber of the vacuum cleaner to remove a wide variety of particles and/or gases in the air.

In accordance with still yet another and/or alternative aspect of the present invention, a support mechanism is employed to maintain one or more of the filters of the filter arrangement in a proper position in the vacuum cleaner and/or to support the one or more filters during the filtration of the air. The support mechanism can be incorporated into the filters themselves and/or can be an external mechanism such as a frame. The support mechanism can be one or more pieces. In one embodiment of the invention, the support member is one piece. In another and/or alternative embodiment of the invention, the support member is multiple pieces connected together by various mechanisms such as, but not limited to, bolts, screws, clips, lock tabs, and/or the like. In still another and/or alternative embodiment of the invention, the support mechanism is designed to position and/or to support the one or more filters without impairing the air flow through the one or more filters. In yet another and/or alternative embodiment of the invention, the support mechanism includes a support member having a generally cylindrical or conical shape. In still yet another and/or alternative embodiment of the invention, the outer perimeter of the support member has a profile and shape that is substantially the same as the profile and shape of the surface of at least one filter so as to substantially fully support the filter. In one aspect of this embodiment, the support member is at least partially nested in at least one filter. In another and/or alternative aspect of this embodiment, at least one filter is at least partially nested in the support member. In a further and/or alternative embodiment of the invention, the outer perimeter of the support member has a profile and shape that is smaller than the profile and shape of the surface of the filter, so as to cause the filter to at least partially collapse onto the support member when air is drawn through the filter. In one aspect of this embodiment, the support member is nested in at least one filter and the at least one filter at least partially collapses on the support member during the operation of the vacuum cleaner. In still a further and/or alternative embodiment, the support mechanism includes a support member having a plurality of fin sections. In one aspect of this embodiment, a plurality of the fin sections are spaced apart from one another. In another and/or alternative aspect of this embodiment, a plurality of fin sections are generally symmetrically positioned apart from one another. In still another and/or alternative aspect of this embodiment, the outer surface of the fin sections forms a generally cylindrically shaped or conically shaped support member. In yet another and/or alternative aspect of this embodiment, at least one opening exists between at least two adjacently positioned fin sections. In yet a further and/or alternative embodiment of the invention, the support member includes at least one rigidity arrangement that at least partially extends between at least two adjacently positioned fin sections. In one aspect of this embodiment, the rigidity arrangement includes at least one rigidity panel. The rigidity panel provides structural rigidity to the support member thereby at least partially inhibiting or preventing deformation of the support member during operation of the vacuum cleaner. In another and/or alternative aspect of this embodiment, at least one rigidity panel is positioned between all adjacently portioned fin sections. In yet another and/or alternative aspect of this embodiment, at least one rigidity panel is positioned at least closely adjacent to the rim of the support member. In one non-limiting design, one or more of the rigidity panels are at least partially recessed from the outer peripheral edge of the fin sections. In another and/or alternative non-limiting design, one or more rigidity panels are at least partially flush with the outer peripheral edge of the fin sections. In still yet another and/or alternative aspect of this embodiment, the rigidity arrangement includes a rim that connects a plurality of fin sections together. The rim at least partially provides structural rigidity to the support member, thereby at least partially inhibiting or preventing deformation of the support member during operation of the vacuum cleaner. In one non-limiting design, the rim connects all the fin sections together. In another and/or alternative non-limiting design, the rim includes a lip to provide ease of handling of the support member, increased structural rigidity, and/or improved sealing. In a further and/or alternative aspect of this embodiment, the rigidity arrangement includes at least one rigidity ring. Like the rigidity panel and rim, the rigidity ring at least partially provides structural rigidity to the support member, thereby at least partially inhibiting or preventing deformation of the support member during operation of the vacuum cleaner. In still a further and/or alternative aspect of this embodiment, the rigidity ring is positioned between the rim and the base of the support member. In one non-limiting design, the rigidity ring is positioned at or close to the mid point between the base and rim of the support member. In another and/or alternative non-limiting design, at least one rigidity panel extends upwardly from the rigidity ring and toward the rim of the support member. In still yet a further and/or alternative embodiment of the invention, the support mechanism includes a sealing arrangement to at least partially inhibit or prevent air from circumventing through one or more filters of the filter arrangement and/or support member. In one aspect of this embodiment, air enters the vacuum cleaner and is drawn through one or more filters of the filter arrangement and through the support member. Air that is able to circumvent the one or more filters of the filter arrangement will not be properly filtered. The sealing arrangement is designed to at least partially ensure that most, if not all, of the air entering the vacuum cleaner is directed through one or more filters of the filter arrangement and through the support member. In another and/or alternative aspect of this embodiment, the sealing arrangement includes a sealing ring. In one non-limiting design, the sealing ring is made of a resilient material such as, but not limited to, plastic and/or rubber material; however, other materials can be used. In still another and/or alternative non-limiting design, the sealing ring is typically made of a flexible and/or compressible material. In still another and/or alternative non-limiting design, the sealing ring is at least partially placed on and/or secured to the rim of the support member. In yet another and/or alternative non-limiting design, the sealing ring at least partially forms a seal between the support member and low velocity chamber of the vacuum cleaner when the support member is inserted into the low velocity chamber. The sealing ring causes air entering the low velocity chamber to pass through the one or more filters of the filter arrangement that are positioned adjacent the support member.

In accordance with a further and/or alternative aspect of the invention, the filter arrangement includes at least one filter having a filter profile that reduces the quantity of large particles entering the low velocity chamber of the vacuum cleaner from being entrapped, caught, or otherwise embedded on at least one of the filters. This reduction in the number of large particles being entrapped, embedded, and/or caught on one or more of the filters during the air filtering process increases the life and efficiency of the filter arrangement. In one embodiment of the invention, at least one of the filters includes a rib and/or trough profile on the outer peripheral surface of the filter. The rib and/or trough profile can be a rigid or semi-rigid structure of the filter, or be a result of the deformation of the filter during the air filtering process. In one aspect of this embodiment, the surface area of the trough portion of the filter is generally greater than the surface area of the rib portion of the filter. In another and/or alternative aspect of this embodiment, the one or more ribs are designed to at least partially function as a first contact barrier to particles entrained in the air. The larger particles in the air, upon contact with the one or more ribs, are stopped or reduced in velocity by the one or more ribs. The stopping or reduction in velocity of large particles at least partially causes the particles to drop out of the entrained air and onto the base of the low velocity air chamber. Due to the relatively small surface area of the rib portion of the filter, the larger particles have less area to stick to, and thus tend to fall off of the rib portion. In addition, since the ribs are generally first exposed to the air, larger particles that have stuck to the ribs are subsequently at least partially knocked off by other particles contacting the ribs. As a result, many of the larger particles are knocked out of the air prior to the air contacting the trough portion of the filter. The reduction in the number of particles contacting the trough portion of one or more filters results in the filter having a longer life. In another and/or alternative embodiment of the invention, one or more filters having the rib and trough profile are exposed to a circular or cyclonic air stream. This type of air path is generally produced in canister type vacuum cleaners; however, other types of vacuum cleaners can produce such an air path. The circular or cyclonic air stream causes many of the particles in the particle entrained air to first contact the side and front of the rib portions of the filter prior to the air contacting the trough portion of the filter since the rib portions extend farther out into the air stream path than the trough portions. In still another and/or alternative embodiment of the invention, one or more filters having the rib and trough profile have a generally cylindrical or conical shape. In yet another and/or alternative embodiment of the invention, at least one filter having a rib and/or trough profile is at least partially supported by a support arrangement that includes a support member that is at least partially nested in the filter of the filter arrangement. In one aspect of this embodiment, the filter can be a particle and/or gas filter. In another and/or alternative aspect of this embodiment, the support member can be nested in more than one filter, such as two or more filters nested together, and the support member being nested in the two or more nested filters. In still another and/or alternative aspect of this embodiment, when one filter is used, typically the filter is a particle filter or includes a particle filtering section. In yet another and/or alternative aspect of this embodiment, when more than one filter is used, typically at least one of the filters is a particle filter or includes a particle filtering section. In still yet another and/or alternative aspect of this embodiment, the support member has a shape and/or size that is equal to or smaller than the shape and size of the one or more filters being at least partially supported by the support member. In one non-limiting design, the support member has a smaller shape and/or size as compared to the filter to be supported. In another and/or alternative non-limiting design, the support member has a plurality of fins that are spaced apart from one another. This fin structure of the support member at least partially results in ribs forming on a flexible filter when the filter at least partially deforms onto the fin structure when exposed to vacuum pressure. The fin structure of the support member at least partially causes the filter to form ribs, and the spacing between the fins allows the filter to form troughs between the fins. In a further and/or alternative aspect of this embodiment, at least one filter is formed to include one or more fins and/or toughs and the formed filter is at least partially fitted over the support member having one or more fins. In this design, the fins on the support member at least partially maintain the form of the filter when the filter is subjected to vacuum pressure.

In accordance with still a further and/or alternative aspect of the invention, the filter arrangement includes a safety filter to at least partially prevent large particles from entering the motor section of the vacuum cleaner and/or contacting the motor fan. During the operation of the vacuum cleaner, one or more particle filters may be damaged or become damaged during use of the vacuum cleaner and/or from improper installation. For instance, large particles such as, but not limited to, glass pieces, nails, tacks, rocks, etc., may contact the one or more particle filters and puncture and/or cut the one or more particle filters. As a result of this damage to the one or more particle filters, larger particles can thereafter pass through the one or more particle filters and into the motor chamber of the vacuum cleaner, thereby potentially resulting in damage to the motor and/or fan, and/or the clogging of the air exhaust of the vacuum cleaner. Alternatively, the one or more particle filters may be inadvertently left out of the vacuum cleaner or improperly inserted in the vacuum cleaner, thus allowing particles to enter the motor chamber. The safety filter is designed to at least partially inhibit or prevent such particles from entering the motor chamber. In one embodiment of the invention, the safety filter is designed to at least partially remove larger particles and to allow smaller particles to pass therethrough. Such a design allows the safety filter to be made of a less dense material so as to not significantly contribute to pressure drop through the filter arrangement. In one aspect of this embodiment, the safety filter is less dense than at least one of the particle and/or gas filters used in the filter arrangement. In another and/or alternative aspect of this embodiment, the safety filter allows a majority of particles having a size less than about 5 microns to pass through the safety filter. In still another and/or alternative aspect of this embodiment, the safety filter allows a majority of particles having a size less than about 10 microns to pass through the safety filter. In another and/or alternative embodiment of the invention, the safety filter is a conically or a cylindrically shaped filter; however, the safety filter can have other shapes. In still another and/or alternative embodiment of the invention, the safety filter is at least partially designed to be inserted into an inner region of the support member of the support arrangement. In one non-limiting design, the outer peripheral surface of the support member supports one or more filters of the filter arrangement and an inner region of the support member receives the safety filter. In such a design, the safety filter has generally the same shape as the shape of the outer peripheral surface of the support member and/or the one of more filters supported by the outer peripheral surface of the support member; however, the safety filter can have other shapes. In yet another and/or alternative embodiment of the invention, the safety filter is at least partially held in position in the support member by a filter support. The filter support can also maintain the shape of the safety filter during the vacuum process so as to minimize or prevent deformation of the safety filter. In one aspect of this embodiment, the filter support is nested in the safety filter, while the safety filter nests in the support member. In another and/or alternative aspect of this embodiment, the filter support allows for easy removal and replacement and/or cleaning of the safety filter. In still another and/or alternative aspect of this embodiment, the safety filter and filter support are at least partially entrapped between two or more pieces of the support member.

In accordance with yet a further and/or alternative aspect of the invention, the filter arrangement includes a post exhaust gas filter. The post exhaust gas filter is designed to at least partially remove undesired gases and/or odors such as, but not limited to, smoke, fumes, gas contaminants, and/or noxious gases from the filtered air after the filtered air exits the motor section of the vacuum cleaner. In past vacuum cleaner designs, all the filters were positioned upstream from the motor section, and the filtered air was blown directly out of the motor section and into the environment. As a result, odors caused from the operation of the vacuum motor were expelled from the vacuum cleaner. The positioning of the post exhaust gas filter at a location after the filtered air exits the motor section allows the gas filter to at least partially absorb and/or adsorb odors caused by the motor and/or any odor that may have penetrated the other filters of the filter arrangement. Consequently, substantially odor free air is expelled from the vacuum cleaner during the vacuuming process. In one embodiment of the invention, the post exhaust gas filter is the only or the primary gas filter in the filter arrangement. In another and/or alternative embodiment of the invention, the post exhaust gas filter is a secondary gas filter in the filter arrangement. In still another and/or alternative embodiment of the invention, the post exhaust gas filter can be removed from the vacuum cleaner without having to remove one or more other filters of the filter arrangement. As a result, the post exhaust gas filter can be replaced as needed independently of the other filters of the filter arrangement. In yet another and/or alternative embodiment of the invention, the post exhaust gas filter includes a gas absorbing and/or adsorbing substance such as, but not limited to, activated carbon, activated charcoal, lava rocks, and/or baking soda. In still yet another and/or alternative embodiment of the invention, the post exhaust gas filter includes one or more mats, or woven and/or non-woven materials impregnated with one or more gas absorbing and/or adsorbing substances. In a further and/or alternative embodiment of the invention, the post exhaust gas filter includes one or more gas absorbing and/or adsorbing substances in the form of a resin and/or granules. In one aspect of this embodiment, the resin and/or granules are contained in an air permeable device such as, but not limited to, a ventilative bag, ventilative container and/or the like. In still a further and/or alternative embodiment, the post exhaust gas filter includes one or more gas absorbing and/or adsorbing substances impregnated in a textile material. In still yet a further and/or alternative embodiment, the post exhaust gas filter has the same or similar structure and/or composition as one ore more of the other gas filters in the vacuum cleaner.

In accordance with still yet a further and/or alternative aspect of the invention, the filter arrangement includes a post exhaust air freshener. The post exhaust air freshener is designed to emit pleasant odors in the air exiting the vacuum cleaner. In one embodiment of the invention, the post exhaust air freshener can be removed and replaced from the vacuum cleaner without having to remove one or more filters of the filter arrangement. As a result, the post exhaust air freshener can be replaced as needed independently of the filters of the filter arrangement.

In accordance with another and/or alternative aspect of the present invention, the filter arrangement includes a filter liner to enable more convenient disposal of particles that have fallen to the base or bottom of the low velocity chamber. During the vacuum process, large particles accumulate at the bottom of the low velocity chamber. When the filters were replaced, the filters were removed and the bottom portion of the canister had to be carried out to a garbage can or other disposal area to be emptied. The carrying of the canister was both inconvenient and difficult. In addition, the emptying of the canister caused dust and other types of particles to be scattered about the garbage can or other disposal area, resulting in the individual being exposed to unwanted particles and/or messing the area about the garbage can or other disposal area. After the canister was emptied, the user then had to wipe and clean the interior of the canister prior to reuse, thereby exposing the user to more particles and dust, and/or causing other areas to become messy. One prior art liner that has been disclosed from use in a canister-type vacuum cleaner is set forth in Assignee's U.S. Pat. No. 3,342,344, which is incorporated herein by reference. The '344 patent discloses a filter liner and filter arrangement wherein the air pressure is equalized on the inside and outside of the filter liner to prevent collapse of the filter liner. The '344 patent also discloses that the filter liner is connected to a paper filter at a point spaced from the edge of the paper filter. The filter liner is disclosed as being an air impervious bag made of polyethylene or the like. The paper filter includes several openings above the point where the filter liner is bonded to the paper filter so as to equalize the pressure on the inside and outside of the filter liner, thereby preventing the collapse of the filter liner during operation of the vacuum cleaner. Another filter liner arrangement is disclosed in Assignee's U.S. patent application Ser. No. 09/809,841 filed Mar. 19, 2001, which is also incorporated herein by reference. The '841 patent application discloses that a filter liner can be used in conjunction with one or more filters in the low velocity chamber of a canister vacuum cleaner. Although the use of filter liners in canister-type vacuum cleaners have been used, problems still exist with such filter liners. As disclosed in the '344 patent, openings in the paper filter are used to equalize the pressure between the filter liner and the paper filter. However, if one or more openings become clogged during the vacuuming process, the unequalized pressure will cause the filter liner to collapse onto the paper filter, thereby disrupting the proper operation of the vacuum cleaner. In addition, the openings in the paper filter can cause some disruption in the flow of the air in the low velocity chamber which can adversely affect the filter efficiency during the vacuuming process. The openings in the paper filter can also allow particles in the air to pass through the openings and deposit such particles between the filter liner and the base of the low velocity chamber. As a result, the low velocity chamber must still be periodically cleaned even with use of the filter liner. Furthermore, even when the openings in the paper filter are not clogged during operation of the vacuum cleaner, the filter liner will partially collapse at the startup of the vacuum cleaner until equalization is achieved. This partial collapse of the filter liner can cause some disruption in the flow of the air in the low velocity chamber which can adversely affect the filter efficiency during the vacuuming process, and/or can interfere with and/or obstruct the flow of air through one or more portions of the paper filter. The openings in the paper filter also subject the paper filter to increased incidence of damage to the paper filter. Particles entrained in the air can contact the sides of the openings thereby resulting in tearing of the opening. Such tearing of one or more openings can cause some disruption in the flow of the air in the low velocity chamber, which can adversely affect the filter efficiency during the vacuuming process. The adhesive connection of the liner to the paper filter is also subject to damage during operation of the vacuum cleaner. The adhesive bond can be damaged during the insertion and/or removal of the paper filter and filter liner, and/or can be damaged during the operation of the vacuum cleaner. When the adhesive bond is damaged during insertion of the paper filter and filter liner and/or during operation of the vacuum cleaner, the one or more damaged regions can allow air to flow through the one or more damaged regions and can cause some disruption in the flow of the air in the low velocity chamber, which can adversely affect the filter efficiency during the vacuuming process. In addition, the one or more damaged regions can allow particles in the air to pass through the damaged regions and between the filter liner and the low velocity chamber, thereby requiring cleaning of the low velocity chamber. When the adhesive bond is damaged prior to and/or during removal of the filter liner and paper filter, the filter liner may at least partially separate from the paper filter and release the particles on the ground and/or in the low velocity chamber, and/or into the air. The release of such particles may undesirably expose an individual to such particles and/or cause a mess that must be cleaned. The connection of the filter liner to the paper filter also makes it difficult to open up the filter liner and properly fit the filter liner about the base and sides of the low velocity chamber. When the filter liner is not properly set up in the low velocity chamber, improper air flow can occur in the low velocity chamber which can adversely affect the filter efficiency during the vacuuming process. In addition, the improper setup of the filter liner may result in the partial or full collapse of the filter liner during the operation of the vacuum cleaner. The filter liner of the present invention overcomes the deficiencies of past filter liners. In accordance with one embodiment of the invention, the filter liner is designed to at least partially collect the particles that have fallen to the base or bottom of the low velocity chamber. As a result, the filter liner need only be removed with the filters to remove most, if not all, of the particles in the canister. The filter liner can be closed to minimize the amount of particles escaping the filter liner during the filter replacement and disposal process. The filter liner also maintains the cleanliness of the inside of the canister, thereby eliminating the need to clean the canister by hand after every disposal of the filter liner and filter. In another and/or alternative embodiment of the present invention, the filter liner is made of a substantially inflexible or rigid material that will not collapse or substantially deform during the operation of the vacuum cleaner. In one aspect of this embodiment, the inflexible or rigid material includes, but is not limited to, plastic, metal, cardboard, polymer composites, fiberglass and/or other fiber composites, rubber, and/or the like. In still another and/or alternative embodiment of the invention, the filter liner is shaped to at least partially conform to the interior shape of the low velocity chamber. In one aspect of this embodiment, the shape and size of the filter liner allows for easy insertion and removal of the filter liner into and out of the low velocity chamber. In yet another and/or alternative embodiment of the invention, the filter liner includes at least one tab. The tab is used to facilitate in the handling of the filter liner during the insertion and/or removal of the filter liner, and/or provides information about the filter liner and/or use of the filter liner. In one aspect of this embodiment, the filter liner includes a plurality of tabs. In one non-limiting design, at least two tabs are symmetrically oriented on the filter liner. In another and/or alternative aspect of this embodiment, at least one tab is positioned on the top edge of the filter liner. In still yet another and/or alternative embodiment of the invention, the filter liner includes a side opening to allow air and particles into the interior of the filter liner. In one aspect of this embodiment, the opening includes a sleeve that at least partially directs air and particles entering the filter liner to travel along the side of the filter liner so that the air and particles begin a cyclonic path inside the filter liner. In a further and/or alternative embodiment of the invention, the filter liner includes a generally conically-shaped base portion positioned generally in the center of the base of the filter liner. The generally conically-shaped base portion is at least partially designed to encircle a portion of the filter arrangement in the low velocity chamber. The generally conically-shaped base portion is also designed to facilitate in the cyclonic air path of the air and particles in the low velocity chamber.

In accordance with another and/or alternative aspect of the present invention, the filter liner is at least partially connected and/or is connectable to at least one filter of the filter arrangement. In one embodiment of the invention, the filter liner is at least partially connected to at least one filter prior to the insertion of the filter and filter liner into the low velocity chamber. In one aspect of this embodiment, the filter liner is fully connected to at least one filter prior to the insertion of the filter and filter liner into the low velocity chamber. In another and/or alternative aspect of this embodiment, the filter liner is permanently connected to at least one filter prior to the insertion of the filter and filter liner into the low velocity chamber. In this arrangement, both the filter and filter liner are inserted into the low velocity chamber at generally the same time. In still another and/or alternative aspect of this embodiment, at least a portion of a filter is connected to the upper edge and/or upper lip of the filter liner. In yet another and/or alternative aspect of this embodiment, the filter liner is connected to at least one filter by various mechanisms such as, but not limited to, a melted seam, adhesives, stitching, snaps, zipper, staples, clamping arrangement, tongue and groove arrangement, and/or the like. In another and/or alternative embodiment of the invention, the filter liner and at least one filter are connected together just prior to or at the time the filter liner and one or more filters of the filter arrangement are positioned in the low velocity chamber. In one aspect of this embodiment, the filter liner and at least one filter of the filter arrangement are separate components such that the filter liner can be positioned in the low velocity chamber prior to the at least one filter being at least partially connected to the filter liner. In another and/or alternative aspect of this embodiment, the filter liner is connected to at least one filter by various mechanisms such as, but not limited to, a melted seam, adhesives, stitching, snaps, zipper, staples, clamping arrangement, tongue and groove arrangement, and/or the like. In one non-limiting design, the filter liner and at least one filter are connected together by an adhesive. In another and/or alternative non-limiting design, the adhesive is at least partially covered by a removable strip. The removable strip is removed prior to the at least one filter being connected to the filter liner. In still another and/or alternative non-limiting design, the adhesive is positioned at least partially on the filter liner and/or the at least one filter. In yet another and/or alternative non-limiting design, the filter liner includes an adhesive along the complete upper edge and/or upper lip of the filter liner. In still another and/or alternative embodiment of the invention, the filter liner includes a substantially air impermeable material to inhibit or prevent particles from penetrating the filter liner.

In accordance with still another and/or alternative aspect of the present invention, the filter liner includes a sealing arrangement to at least partially form a seal between the filter liner and the low velocity chamber. In one embodiment, the filter liner includes an upper lip that includes at least one rib or notch designed to at least partially mate with a rib or notch on the low velocity chamber. In one aspect of this embodiment, the upper lip of the filter liner includes a notch designed to at least partially mate with a rib on the upper edge of the low velocity chamber. In another and/or alternative aspect of this embodiment, the upper lip of the filter liner includes a rib designed to at least partially mate with a notch on the upper edge of the low velocity chamber. In another and/or alternative embodiment, the seal between the filter liner and the low velocity chamber is at least partially formed by the filter liner being at least partially compressed onto the low velocity chamber when the vacuum cleaner is fully assembled and/or during operation of the vacuum cleaner.

In accordance with yet another and/or alternative aspect of the present invention, the filter liner includes a dust door designed to minimize the amount of particles escaping the interior of the filter liner when the filter liner is removed from the low velocity chamber. In one embodiment of the invention, the dust door at least partially closes by itself when the filter liner is removed from the low velocity chamber. In one aspect of this embodiment, the dust door includes a memory hinge and/or spring hinge that at least partially causes the dust door to close. In another and/or alternative embodiment, the dust door is perforated in the closed positioned prior to the filter liner being inserted in the low velocity chamber. In one non-limiting design, the at least a portion of the perimeter of the dust door is perforated and the perforation is broken when the filter liner is inserted in the low velocity chamber. In still another and/or alternative embodiment of the invention, the dust door includes a substantially air impermeable material to inhibit or prevent particles from penetrating the dust door.

In accordance with still yet another and/or alternative aspect of the present invention, the filter liner has a sealing patch inserted at least partially over the opening in the side of the filter liner to minimize the amount of particles escaping the interior of the filter liner when the filter liner is removed from the low velocity chamber. In one embodiment of the invention, the sealing patch includes an adhesive that is used to connect the sealing patch to the side of the filter liner. In another and/or alternative embodiment of the invention, the filter liner includes an adhesive that is used to connect the sealing patch to the side of the filter liner. In still another and/or alternative embodiment of the invention, the filter liner includes a region for temporarily securing the sealing patch so that the sealing patch can be subsequently removed from the temporary region and inserted over the opening in the filter liner. In yet another and/or alternative embodiment of the invention, the sealing patch includes a substantially air impermeable material to inhibit or prevent particles from penetrating the sealing patch.

In accordance with a further and/or alternative aspect of the present invention, the vacuum cleaner includes a removable canister to facilitate in the convenient disposal of dust and/or debris collected in the low velocity chamber. In prior canister type vacuum cleaners, the whole base portion of the vacuum cleaner had to be transported to a garbage can, lifted, and then emptied to dispose of the dust and debris that had collected in the low velocity chamber. Due to the bulkiness of the canister, the process of disposal of the dust and debris was not convenient, and was often difficult. The vacuum cleaner of the present invention overcomes this problem by designing a canister type vacuum cleaner that includes a lower canister that can be easily separated from the rest of the vacuum cleaner to enable a user to easily and conveniently dispose of dust and debris that has collected in the low velocity chamber. In one embodiment of the invention, the removable lower canister includes a handle. The handle allows a user to easily grasp the lower canister for convenient removal and reinsertion of the canister. The handle also makes it easier for the user to carry the lower canister to a garbage can or other disposal area. In another and/or alternative embodiment of the invention, the lower canister is designed to be slidably removable from the vacuum cleaner when the top portion of the vacuum cleaner is lifted and/or removed. In still another and/or alternative embodiment of the invention, the lower canister is designed to be at least partially removable from the vacuum cleaner so as to facilitate in the insertion and/or removal of one or more filters of the filter arrangement from the low velocity chamber. In yet another and/or alternative embodiment of the invention, the lower canister is designed to be at least partially removable from the vacuum cleaner so as to facilitate in the insertion of the filter liner into and/or removal of the filter liner from the low velocity chamber.

In accordance with still a further and/or alternative aspect of the invention, the low velocity chamber of the vacuum cleaner includes an inlet nozzle that directs particle containing air about the filters in the low velocity chamber. The inlet nozzle, in effect, facilitates in the cyclonic air paths in the low velocity chamber. The inlet nozzle also directs the entering air about the filters in the low velocity chamber as opposed to directly at the filters. In prior canister vacuum cleaners, the low velocity chamber included an opening on one side of the chamber wall to allow entry of incoming air. The incoming air was directed at the filters and then began its cyclonic pathway. As a result, the area on the filter that was in the path of the incoming air prematurely became clogged with particles, thereby reducing the efficiency and life of the filter. The inlet nozzle of the present vacuum cleaner overcomes this problem by causing the incoming air to immediately begin a cyclonic pathway about the filters, thereby resulting in a more uniform distribution of particles about the filters during the filtering process. In one embodiment of the invention, the inlet nozzle is positioned at or close to the base of the low velocity chamber and extends into the interior of the low velocity chamber. The positioning of the inlet nozzle at least partially functions as a barrier to large particles that have fallen to the base of the low velocity chamber, and prevents them from continuing to circulate in the low velocity chamber. As a result, fewer particles are restirred in the low velocity chamber, thereby increasing the efficiency and effectiveness of the filters in the low velocity chamber. In another and/or alternative embodiment of the invention, when a filter liner in inserted into the low velocity chamber, the filter liner includes an elbow of the other structure that fits about the inlet nozzle. This structure of the filter liner functions similarly to the inlet nozzle with respect to the barrier to large particles.

In accordance with yet a further and/or alternative aspect of the invention, the vacuum cleaner includes an air exhaust that increases the efficiency of air flow through the vacuum cleaner. Prior canister vacuum cleaners directed filtered air through several openings positioned about the perimeter of the motor housing. It has been found that by directing all of the filtered air through a single opening, the throughput efficiency of the air is increased. In one embodiment of the invention, a motor housing is included about the motor and fan of the vacuum cleaner and includes a single opening for allowing the filtered air to exit the housing. In another and/or alternative embodiment of the invention, an expanding air passageway is connected to the opening of the motor housing. The expanding passageway at least partially directs filtered air from the motor housing to the external housing of the vacuum cleaner. In one aspect of this embodiment, the width of the expanding passageway at least partially expands along the length of the expanding passageway. In another and/or alternative aspect of this embodiment, the height of the expanding passageway at least partially expands along the length of the expanding passageway. In still another and/or alternative embodiment of the invention, the expanding air passageway directs filtered air into an exhaust chamber that includes one or more filters and/or air fresheners. In one aspect of this embodiment, the opening into the exhaust chamber is greater than the opening of the motor housing. In another and/or alternative aspect of this embodiment, the filter in the exhaust chamber includes a gas filter. In still another and/or alternative aspect of this embodiment, the filter in the exhaust chamber includes a particle filter. In still yet another and/or alternative aspect of this embodiment, the exhaust chamber includes an air freshener. In a further and/or alternative aspect of this embodiment, the exhaust chamber includes a single opening to expel filtered air from the external housing of the vacuum cleaner. In one non-limiting design, the opening in the exhaust chamber is similar in size to the opening into the low velocity chamber. In another and/or alternative non-limiting design, the opening in the exhaust chamber is similar in size to the opening between the motor housing and expanding air passageway.

The primary object of the present invention is the provision of a novel filter system that can effectively filter out a majority of the particles entrained in the air and/or to remove odors in the air as the air passes through the filter without causing a large pressure drop, and that can be easily used in a vacuum cleaner such as a canister type vacuum cleaner.

Another and/or alternative object of the present invention is the provision of a filter system which can be easily changed.

Still yet another and/or alternative object of the present invention is the provision of a filter system which has a large surface area for filtration.

Yet another and/or alternative object of the present invention is the provision of a conical filter system adapted to be held in a nested position.

Still a further and/or alternative object of the present invention is the provision of a filter system which is fixedly located in the reduced air velocity chamber of a vacuum cleaner so that low velocity air passes through the filter system to provide resident time to contact the large surface area of the filter system so as to remove particles from the air being cleaned by the vacuum cleaner.

A further and/or alternative object of the present invention is a vacuum cleaner which includes using a particle filter in combination with a gas filter to remove both particles and unwanted gases from the air.

Another and/or alternative object of the present invention is a vacuum cleaner designed to minimize the air pressure drop throughout the vacuum cleaner, thereby reducing the need for a large motor to draw in and expel air from the vacuum cleaner.

Still another and/or alternative object of the present invention is the design of a compact and portable vacuum cleaner which can be easily moved to different rooms by a user.

Yet another and/or alternative object of the present invention is a vacuum cleaner that includes a substantially rigid filter liner to conveniently remove settled particles and debris in the vacuum cleaner.

Still yet another and/or alternative object of the present invention is a vacuum cleaner that includes a filter liner which includes at least one tab to facilitate in the convenient insertion and/or removal of the filter liner in the vacuum cleaner.

A further and/or alternative object of the present invention is a vacuum cleaner that includes a filter liner having a dust door which reduces the amount of particles that escape the filter liner during the disposal of the used filter liner.

Yet a further and/or alternative object of the present invention is a vacuum cleaner that includes a filter liner which is connected to one or more filter layers.

Still a further and/or alternative object of the present invention is a vacuum cleaner that includes a sealing patch which covers the side opening of a used filter liner to reduce the amount of particles that escape the filter liner during the disposal of the used filter liner.

Still yet a further and/or alternative object of the present invention is a vacuum cleaner that has a removable canister to facilitate in easier cleaning of the vacuum cleaner.

Another and/or alternative object of the present invention is a vacuum cleaner that filters gases from the exhaust of the vacuum cleaner.

Still another and/or alternative object of the present invention is a vacuum cleaner that includes a particle filter having a rib and trough profile which efficiently removes small particles entrained in the air.

Yet another and/or alternative object of the present invention is a vacuum cleaner that freshens air prior to exhausting the air from the vacuum cleaner.

Still yet another and/or alternative object of the present invention is a vacuum cleaner that has a filter support which causes rib and trough sections to be formed in a filter when the filter at least partially collapses on the filter support during operation of the vacuum cleaner.

A further and/or alternative object of the present invention is a vacuum cleaner that has a filter to at least partially prevent large particles from entering the motor chamber of the vacuum cleaner.

These and other objects and advantages will become apparent from the following description taken together with the accompanying drawings.

BRIEF DESCRIPTION OF THE DRAWINGS

Reference is now made to the drawings, which illustrate various embodiments that the invention may take in physical form and in certain parts and arrangement of parts wherein.

DESCRIPTION OF THE PREFERRED EMBODIMENT

Figure 1:
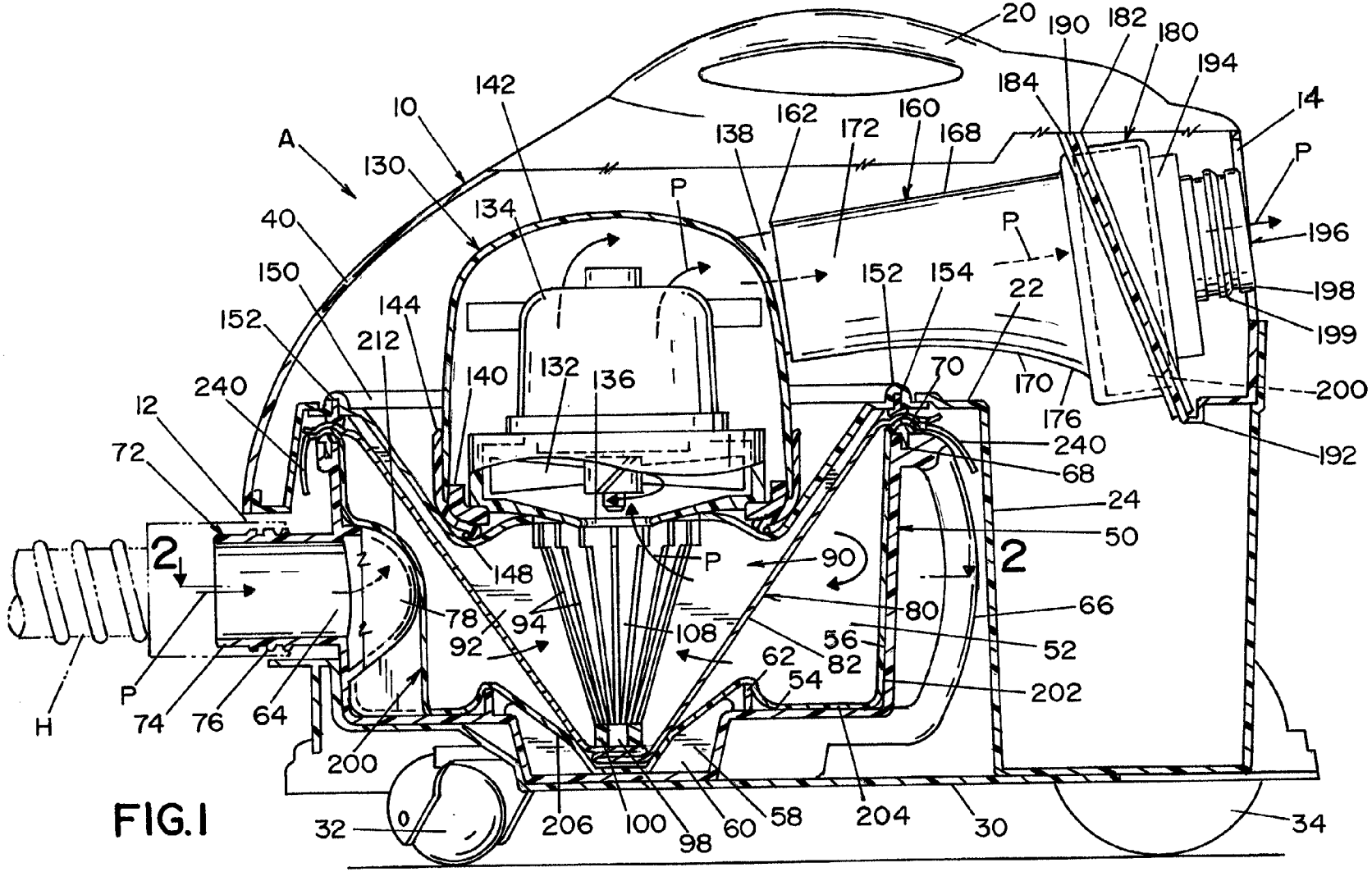
FIG. 1 is a cross-sectional view of the canister type vacuum cleaner of the present invention.

Referring now to the drawings, wherein the showings are for the purpose of illustrating a preferred embodiment of the invention only and not for the purpose of limiting same, FIG. 1 shows a canister type vacuum cleaner A having a housing 10 which is similar in design to the vacuum cleaner housing disclosed in U.S. Pat. No. Des. 432,746 and in U.S. patent application Ser. No. 09/809,841 filed Mar. 19, 2001, which are incorporated herein by reference. At the top of the housing, there is a handle 20 designed to enable a user to carry or move the vacuum cleaner to various locations, and/or to lift a portion of the housing to access one or more internal components of the vacuum cleaner such as the filters. Secured to the base 30 of the housing are two sets of wheels 32, 34. Wheels 32 are swivel wheels that are connected to the front of the base and enable the vacuum cleaner to be moved in a variety of directions. Wheels 34 are non-swivel wheels that are connected to the rear of the base. As can be appreciated, all the wheels can be the same type of wheel. A portion of the housing includes a clear or transparent section or panel 40 which enables a user to view the interior of the housing. Typically, the clear section 40 allows the user to view the amount of dust and/or dirt that has accumulated in the low velocity chamber 52. The clear section may also or alternatively allow the user to view the condition of one or more filters in the low velocity chamber so that the user can determine if one or more filters need to be replaced. As can be appreciated, the clear section can be eliminated and a non-clear section can be used.

Housing 10 includes a canister 50, a motor housing 130, expanding exhaust conduit 160, and an exhaust filter housing 180. Canister 50 includes a generally cylindrical low velocity chamber 52. Low velocity chamber 52 includes a base 54 and side wall 56. The base 54 includes filter well 58 containing a filter support 60 and a dirt flange 62 positioned about the filter well. Side wall 56 includes a side opening 64. Canister 50 also includes a handle 66 connected to the side wall 56. Positioned at the top of side wall 56 is a slot 68 which retains a seal ring 70 which forms a rib-like structure on the top surface of canister 50. Positioned in side opening 64 is an inlet nozzle 72. Inlet nozzle 72 includes a tubular extension 74 that extends outwardly from canister 50 and through an opening 12 in housing 10. Positioned on the outer surface of tubular extension 74 are a plurality of ribs or ridges 76 which are designed to secure a vacuum hose H to tubular extension 74. Inlet nozzle 72 also includes an elbow section 78 positioned in the interior of the low velocity chamber.

Figure 2:
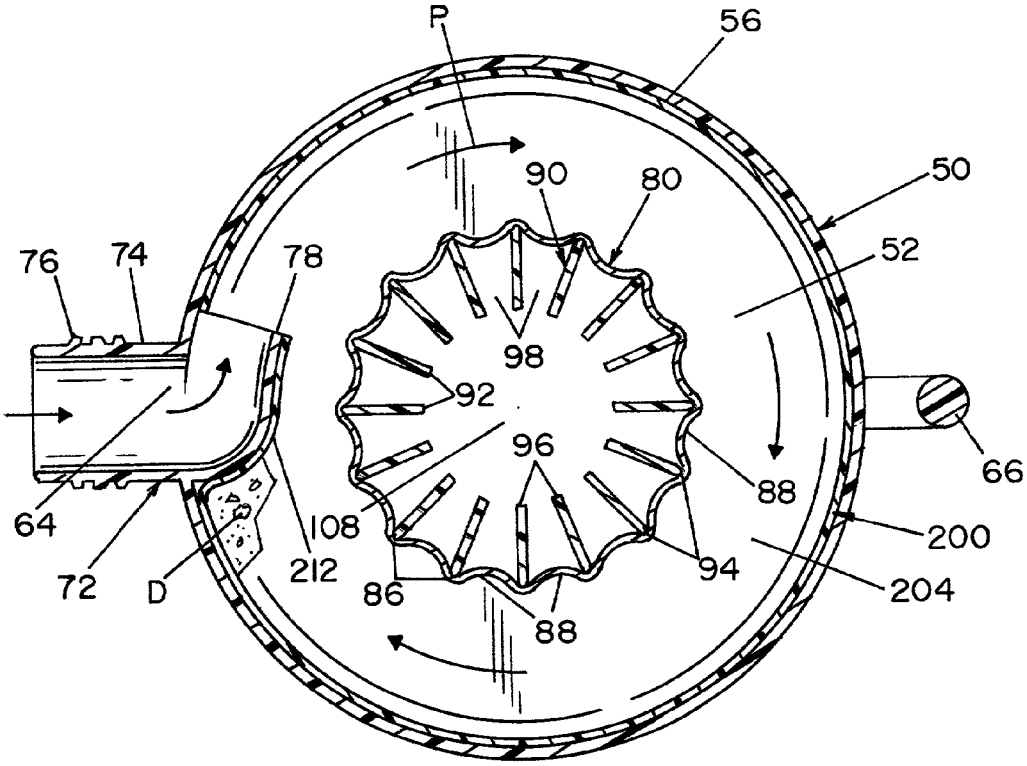
FIG. 2 is a cross-sectional view of a filter subject to a vacuum taken along line 2—2 of FIG. 1.

Air flow through the vacuum cleaner is illustrated by arrows defining a path P. As shown in FIG. 1, particle-entrained air flows through hose H and into tubular extension 74 of inlet nozzle 72. The particle-entrained air continues to flow through inlet nozzle 72, and the air path is altered by elbow section 78. In low velocity chamber 52, path P is in the form of a vortex or cyclone of several convolutions, so that particles carried by air into the low velocity chamber are removed by centrifugal force. Referring to FIG. 2, the air flow in the low velocity chamber is illustrated. The air passing through inlet nozzle 72 has a much higher velocity than in the low velocity chamber. As a result, large particles in the air are carried through hose H and through the inlet nozzle by the high velocity air. When the air enters the low velocity chamber, the air velocity is significantly reduced, thus resulting in the larger particles D precipitating out of the air stream and falling to the base of the low velocity chamber. The path of the air flow as shown in FIG. 2 begins along side wall 56 of the low velocity chamber. As a result, the larger particles fall to the base at or near the side wall of the low velocity chamber. The path of the air flow then causes the particles at the base of the low velocity chamber to move slowly about the perimeter of the base. The elbow section of inlet nozzle 72 functions as a barrier to at least partially inhibit or prevent the particles from continuing to circulate about the base of the low velocity chamber. The accumulated large particles D are illustrated in FIG. 2. The reduction in movement or swirling of the larger particles increases filter efficiency and reduces the number of larger particles becoming re-entrained in the air. As the volume of large particles D increases in the low velocity chamber, the accumulation behind the elbow section increases. Dirt flange 62, as shown in FIG. 1, and side wall 56 maintain the accumulated particles in a specific region of the base of the low velocity chamber.

Figure 4:
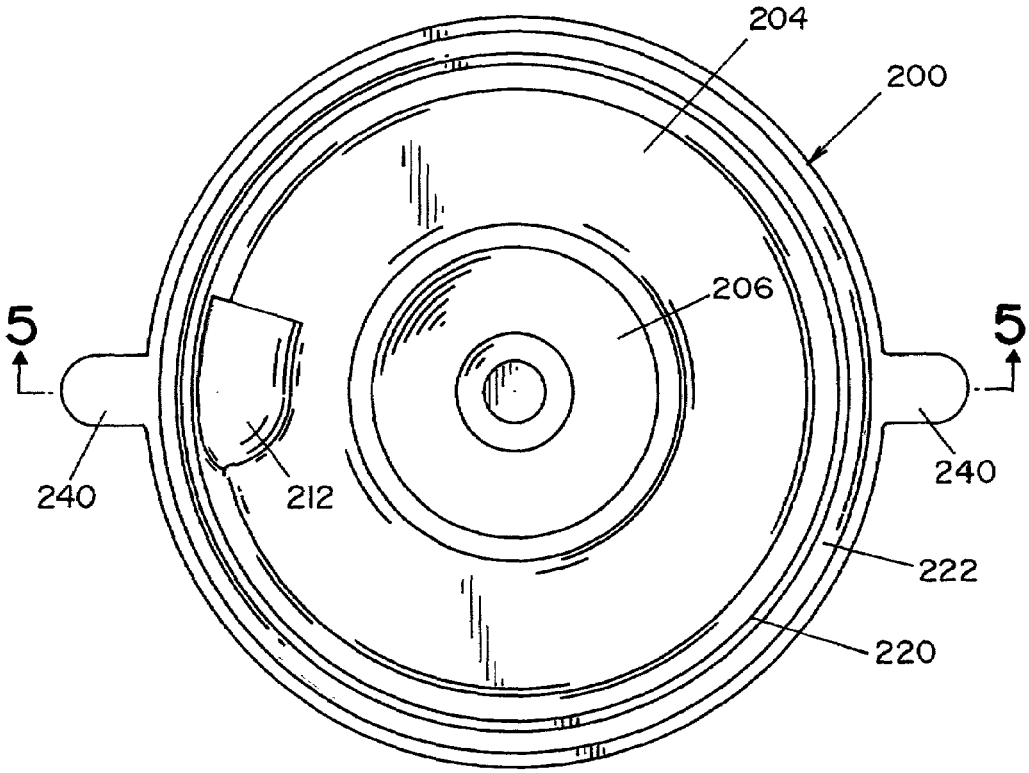
FIG. 4 is a top view of the filter liner the present invention.
Figure 5:
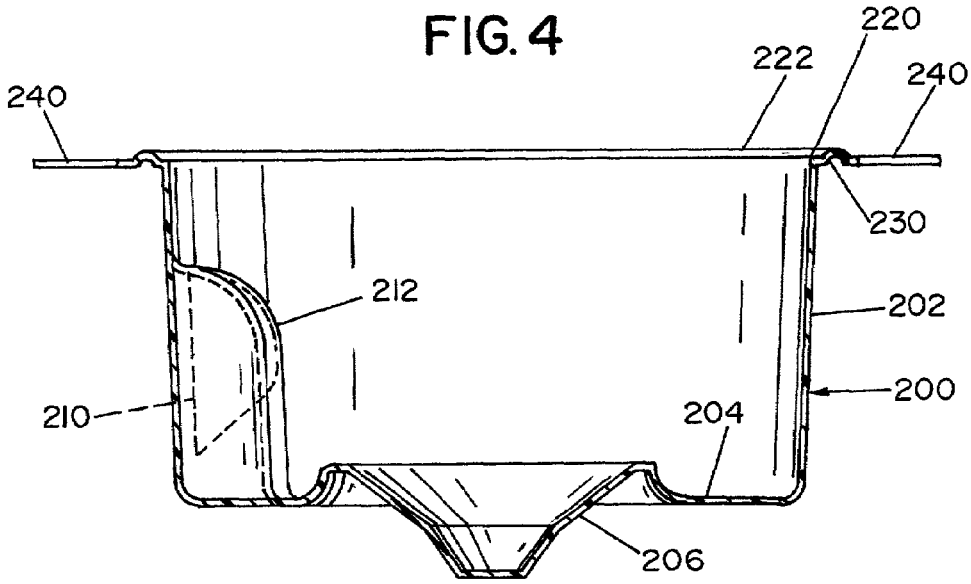
FIG. 5 is a cross-sectional view of a filter subject to a vacuum taken along line 5—5 of FIG. 4.
Figure 6:
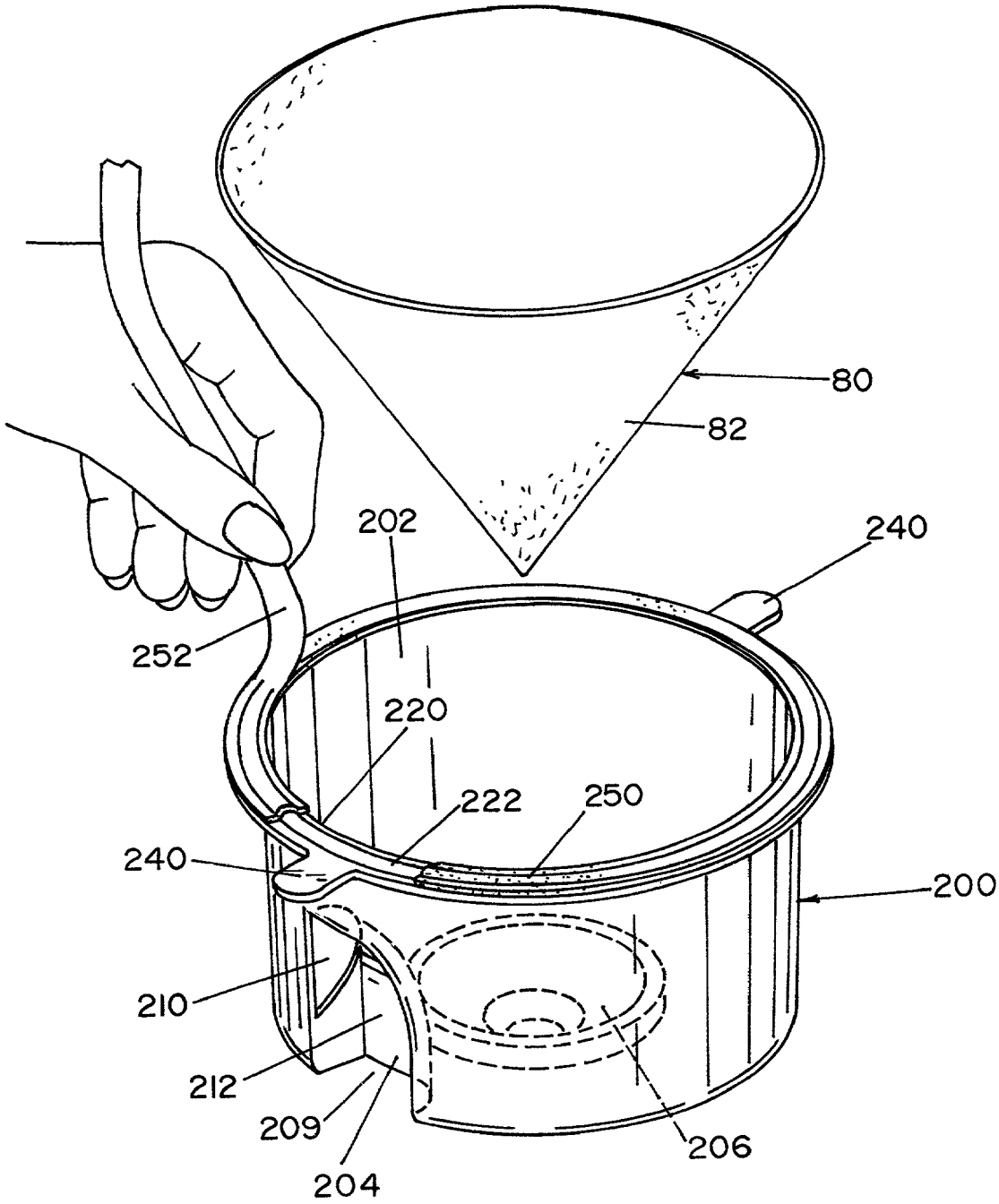
FIG. 6 is an exploded perspective view of the filter liner having an adhesive strip and filter.

As illustrated in FIGS. 1 and 2, a filter liner 200 is inserted in the base of the low velocity chamber. The use of the liner simplifies the disposal of dirt in the canister and reduces the amount of time and effort needed to clean the interior of the low velocity chamber after each filter replacement. The filter liner is formed of a substantially air impermeable material such as a plastic material; however, other materials can be used. The filter liner is also made of a noncollapsible material that resists deformation during the operation of the vacuum cleaner. Typically, the liner is made from a blow-molded plastic. As illustrated in FIGS. 1 and 2, the filter liner is shaped so as to closely conform to the majority of the inner surfaces of the side walls of the low velocity chamber and to generally conform to the base of the low velocity chamber. As can be appreciated, the filter liner can be formed to more closely conform to the shape of the base of the low velocity chamber, and/or conform less closely to the side of the low velocity chamber. Referring now to FIGS. 4 and 5, filter liner 200 includes a side wall 202 and a base 204. Base 204 includes a generally conical portion 206 in the center of the base that is designed to fit in a filter support 60 of the low velocity chamber. The filter liner also includes a side opening 210 and an elbow 212 which are designed to receive elbow section 78 of inlet nozzle 72. Elbow 212 of the filter liner, like the elbow section of inlet nozzle 72, functions as a barrier to at least partially inhibit or prevent the particles from continuing to circulate about the base of the low velocity chamber. Elbow 212 is illustrated as having an upper curved portion that closely conforms to the top curved surface of elbow section 78 of the inlet nozzle. The lower portion of elbow 212 extends vertically downward to intersect with base 204 of the filter liner. As can be appreciated, elbow 212 can be designed to closely conform to the full shape of elbow section 78 of the inlet nozzle. As best illustrated in FIG. 6, the outside side of the filter liner includes an opening cavity 209 for opening 210. The shape of the opening cavity is designed to facilitate in the insertion and removal of the filter liner from the low velocity chamber. Connected to the top edge 220 of the filter liner is an upper lip 222. The upper lip extends outwardly from the side wall of the filter liner. Positioned on the bottom surface of the upper lip is a sealing notch 230 which is designed to form a substantially air tight seal with the upper edge of the low velocity chamber. Two tabs 240 are diametrically positioned on the upper lip of the filter liner. The tabs are used to remove and/or position the filter liner in the low velocity chamber. The tabs can also include information about the filter liner and/or the vacuum cleaner.

Figure 10:
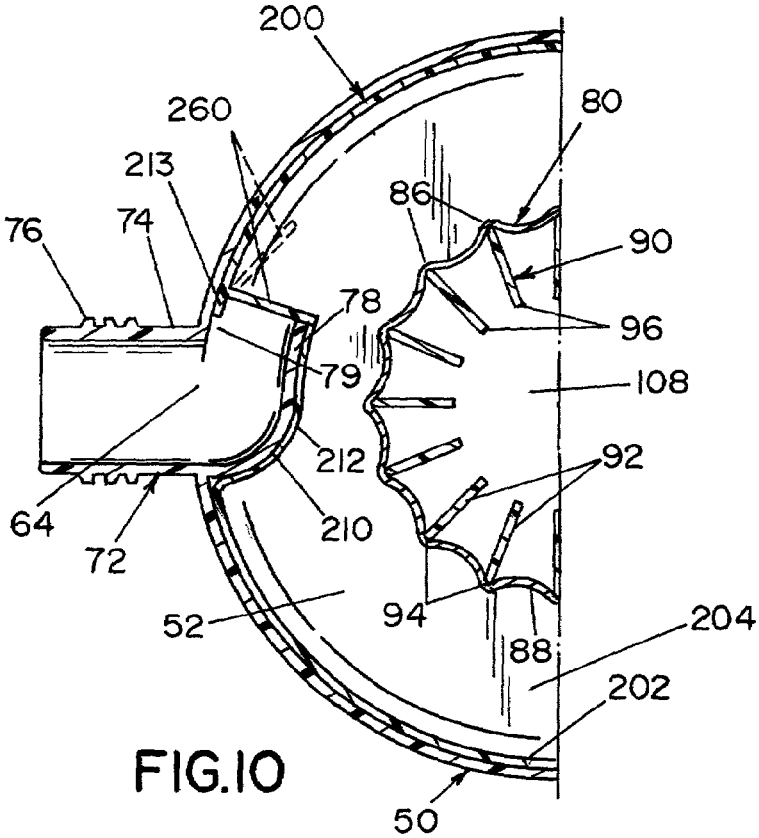
FIG. 10 is an enlarged sectional top view of a modified filter liner positioned about the inlet nozzle of the vacuum cleaner; and, FIG. 11 is a cross sectional view similar to FIG. 3 illustrating the top of the filter liner not connected to the filter.

Referring now to FIG. 10, the elbow of the filter liner includes a seal flange 213. The seal flange is designed to be inserted to a slot 79 on the inlet nozzle 78. The seal flange facilitates in maintaining the filter liner in position in the low velocity chamber. The seal flange also or alternatively forms a seal between the filter liner and the inner surface of the low velocity chamber in a region about the inlet nozzle. After the air flows through the inlet nozzle, the air flows into the filter liner. At a location near the inside wall of the low velocity chamber and where the inlet nozzle ends and the filter liner begins, the inflowing air has a tendency to flow behind the filter liner. The seal flange is designed to inhibit or prevent such air flow patterns. The seal flange extends rearwardly of the opening of the inlet nozzle and into slot 79. The seal flange is illustrated as a thin strip of material extending from the side of the filter liner. The seal flange can be integrally formed with the filter liner, or be later connected to the filter liner. The seal flange can be the same or a different material than the filter liner. In one embodiment, the seal flange is a paper strip, plastic strip, cardboard strip, and/or the like, that is connected to the side of the filter liner by an adhesive, heat bonding, VELCRO, and/or the like. As can be appreciated, other designs of the seal flange can be used such as, but not limited to, a bead of plastic or rubber, or the like.

The air flow path P in the low velocity chamber maintains a generally cyclonic pathway until the air contacts filter 80. Thereafter, air flow path P is generally in an upwardly vertical direction so that the air being cleaned moves through a generally conically-shaped filter 80. The generally conical filter is designed to remove very small particles from the air. In general, filter 80 is designed to remove the majority of particles entrained in the air as the air passes through the filter. Typically, filter 80 is a High Efficiency Particulate Air (HEPA) filter. The filter can include one or more filter sections to remove particles mechanically and/or electrostatically from the air. When filter 80 is made of multiple layers, the multiple layers can be connected together by any conventional means. The fibers used in the filter may be all cellulosic fibers, all synthetic textile fibers or a mixture of cellulosic fibers and synthetic textile fibers. A wide variety of synthetic fibers may be used including acrylic fibers, polyester fibers, nylon fibers, olefin fibers, and/or vinyl fibers, and the like. The cellulosic fiber may be cellulose fibers, modified cellulose fibers, methylcellulose fibers, rayon, and/or cotton fibers. Generally, the filter layers are connected together by a binder, melted seam, adhesive, stitching, and/or are needle pointed together. The materials used to form each layer may be the same or different. In addition, the layers may be all woven or non-woven or a combination thereof. Typically, the exterior surface 82 of filter 80 is made up of a relatively durable material so as to resist damage to the filter during operation of the vacuum cleaner and/or during insertion or removal of the filter from the vacuum cleaner. Filter 80 is typically formed of materials which resist growth to mold, mildew, fungus, or bacteria. The materials also typically resist degradation over time, and are able to withstand extremes in temperatures and humidity, i.e. up to 70° C. (158° F.) and 100% relative humidity. As can be appreciated, filter 80 can be designed to be, if desired, used in both wet and dry environments.

Typically, filter 80 removes substantially all particles having a size greater than 2 microns. Filter 80 typically has about a 99% air filtration efficiency for particles greater than 2 microns in size. In one specific design, filter 80 filters out over about 99.9% of the particles 2 microns or greater in size, and typically over about 99% of the particles about 0.3 micron or greater in size. For particles from about 0.3–2.0 microns, filter 80 generally has a filtration efficiency of at least about 70% and more preferably at least about 99.9%. Particle removal efficiencies as high as 99.98% for particles 0.1 micron and greater in size and at air flow rates of 10–60 CFM are achievable by filter 80. As a result, out of the millions of air particles entering the low velocity chamber of the vacuum cleaner, only relatively few extremely small particles pass through filter 80. The weight of the materials of filter 80 generally is about 30–300 gm/m$^2$, and typically about 50–250 gm/m$^2$, which results in a very nominal pressure drop as the air passes through filter 80.

Filter 80 can also include a gas absorbing and/or adsorbing substance. The gas absorbing and/or adsorbing substance can be incorporated into the particle filter layer or layers and/or can be formed from a separate filter layer and/or altogether separate filter. The gas absorbing and/or adsorbing substance is designed to remove undesirable gases from the air, such as smoke or other undesirable odors. The gas absorbing and/or adsorbing substance can include a variety of powders such as, but not limited to, activated carbon, activated charcoal, diatomaceous earth, Fuller's earth, volcanic rock, lava rock, baking soda, and/or the like. The gas absorbing and/or adsorbing substance typically removes odors caused by, but not limited to, aromatic solvents, polynuclear aromatics, halogenated aromatics, phenolics, aliphatic amines, aromatic amines, ketones, esters, ethers, alcohols, fuels, halogenated solvents, aliphatic acids, and/or aromatic acids. One particular gas and particle filter which can be used is sold under the trademark MEDIpure. The MEDIpure filter is more fully described in U.S. Pat. No. 6,090,184, which is incorporated by reference.

The shape and position of the conical filter 80 is maintained by a filter support 90. Typically, the filter support nests within filter 80. Referring now to FIGS. 1 and 2, filter support 90 is conically-shaped and formed by a plurality of fin sections 92 that are generally positioned symmetrically from one another. Each fin section has an outer edge 94 and inner edge 96. The lower portion of the filter support includes an opening 98 positioned between two adjacently positioned fin sections. The fin sections are maintained in position with respect to one another by being connected together at the base 100 of the filter support. Positioned approximately mid-height of the filter support is a rigidity ring that connects the fin sections together. The filter support also includes a top rim. Positioned between the top rim and rigidity ring are rigidity panels positioned between two adjacent fin sections. The rigidity panels can include openings but are typically solid. As best shown in FIG. 2, the inner edge of the fin sections form an inner cavity 108. The inner cavity is conically-shaped; however, other shapes can be formed. The inner cavity includes a top ledge positioned below the rigidity ring.

Figure 3:
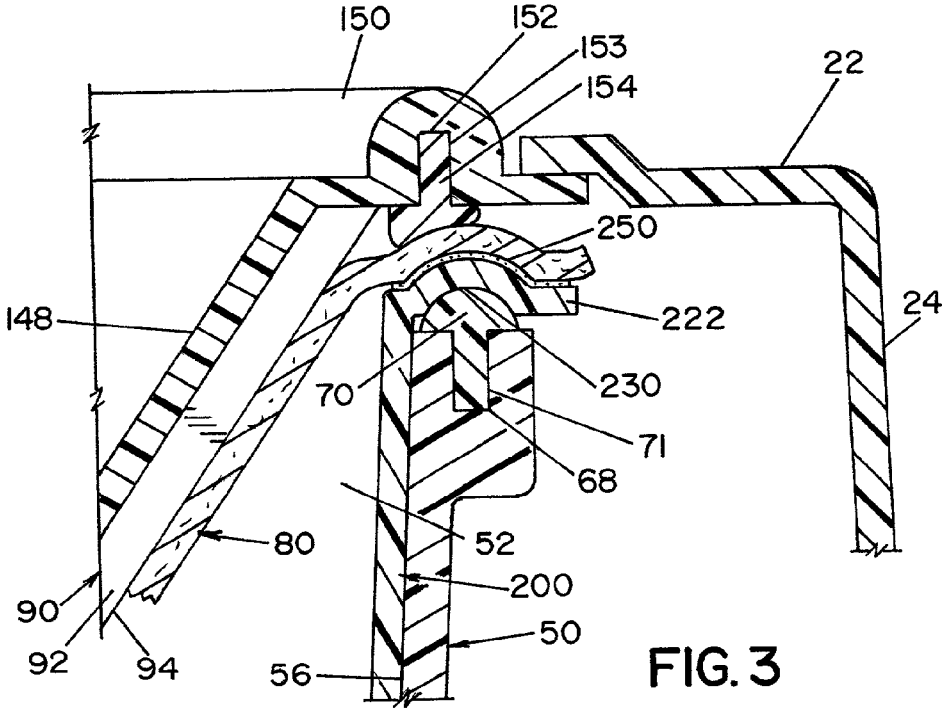
FIG. 3 is an enlarged cross-sectional view of a filter and a filter liner positioned in the low velocity chamber of the canister type vacuum cleaner shown in FIG. 1.

Referring now to FIGS. 1 and 3, the filter liner 200 and filter 80 are shown to be sealed between the canister 50 and motor housing support 148 by seal rings 70 and 154 on the canister and the motor housing, respectively. Motor housing support 148 includes a groove 153, wherein seal ring 154 is inserted therein. Side wall 56 of the canister also includes a groove 71, wherein seal ring 70 is inserted therein. After the filter liner and filter have been inserted into the low velocity chamber, the motor housing is inserted over the canister and the seal rings 70 and 154 compress the filter liner and filter together and form a substantially air tight seal between the motor housing, the filter, the filter liner, and the canister. As previous stated, use of the liner simplifies the disposal of dirt in the canister and reduces the amount of time and effort needed to clean the interior of the low velocity chamber after each filter replacement. Typically, the filter and filter liner are simultaneously disposed of after one or more uses of the vacuum cleaner. Thereafter, a new liner is inserted in the low velocity chamber prior to inserting the filter and filter support 90. Once the filter and filter support are repositioned in filter support 60 in the base of the low velocity chamber, the canister is repositioned on base 30 of housing 10. As can be appreciated, the filter liner, filter and/or filter support can be positioned in the low velocity chamber after the canister has been repositioned in the base. As can further be appreciated, the liner, filter and/or filter support can be removed from the low velocity chamber without having to first remove the canister from base 30. After the filter and filter support are positioned in the low velocity chamber, the upper edge of filter 80 is positioned over seal ring 70 on canister 50. Thereafter, the upper section 22 of housing 10 is pivoted back to the closed position. As shown in FIG. 1, back support 24 retains canister 50 in the proper position when the housing is closed. This procedure is repeated for further filter removals.

As illustrated in FIG. 3, filter liner 200 and filter 80 are connected together by an adhesive 250. The filter liner and filter can be preconnected by the manufacturer, distributor or retailer of the filter liner and filter prior to being offering to the consumer. Alternatively, the filter liner and filter can be offered separately and connected together prior to insertion into the low velocity chamber. Such an arrangement can be accomplished by the modified filter liner disclosed in FIG. 6. Filter liner 200 includes an adhesive bead 250 on upper lip 222. The adhesive bead is covered by a tape strip 252. The tape strip is typically designed so as to easily be removed from the adhesive bead. In one non-limiting design, the tape strip includes a low stick finish such as, but not limited to, a waxy surface finish. The filter and filter liner are connected together by removing the tape strip and inserting the filter in the filter liner. As a result of this arrangement, the filter and filter liner can be sold separately and/or sold without having to be first connected together. Once the filter and filter liner are inserted in the low velocity chamber, seal rings 70 and 154 on canister 50 and motor housing support 148 will cause the filter and filter liner to be pressed together, thereby resulting in an adhesive bond between the filter and filter liner. The adhesive can be selected such that the bond between the filter and filter liner cannot be easily broken once formed. Alternatively, the adhesive can be selected such that the bond between the filter and filter liner can be easily broken once formed. Typically, the adhesive is selected such that the bond between the filter and filter liner cannot be easily broken once formed. One potential advantage of not having a filter preconnected to the filter liner is that the operator may more easily insert the filter liner into the low velocity chamber.

Figure 11:
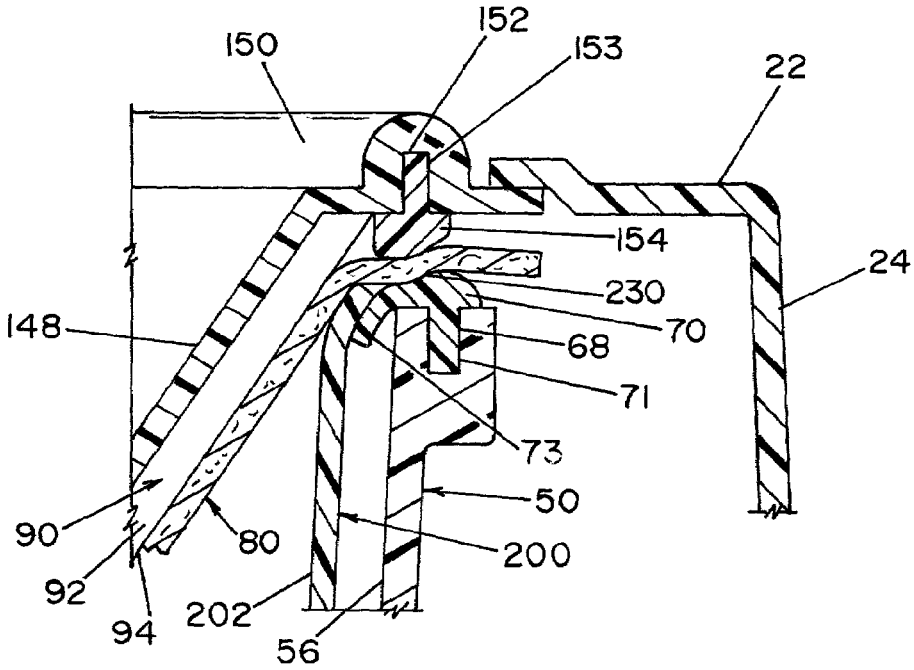

Referring now to FIG. 11, the filter liner can be designed such that the top of the filter liner does not contact and/or is not connected to filter 80. As shown in FIG. 11, the top edge of the filter liner is positioned below filter 80. The top of the filter liner engages a flange 73 of seal ring 70. The flange forms a seal or barrier with the upper edge of the filter liner to inhibit or prevent particles from falling behind the filter liner and into the low velocity chamber. The seal or barrier also or alternatively facilities in the proper air flow from within the filter liner so as to maintain the desired filter efficiencies.

A safety filter is typically positioned in inner cavity 108. The safety filter is designed to at least partially inhibit or prevent large particles or other articles from entering the motor housing and causing damage to the components in the motor housing. Large particles can enter the motor housing when filter 80 becomes torn or otherwise damaged, is improperly positioned in the vacuum cleaner, and/or if the user forgets to place filter 80 in the vacuum cleaner prior to use. The safety filter is used to capture or entrap large particles that pass through the openings of the filter support. Typically, the safety filter is conical in shape to fit in inner cavity 108. A conically-shaped safety filter support is typically used to maintain the safety filter in the inner cavity. The safety filter support generally includes a plurality of openings and a rim. The rim is designed to be positioned on top of ledge of the filter support.

As so far described, air enters the low velocity chamber and large particles fall to the base of the low velocity chamber or into the base of filter liner 200. The small particles in the air are then directed to filter 80 wherein a majority of the particles are filtered out of the air by the filter. The filtered air passing through the filter passes through openings 98 in the filter support. The filtered air then passes through a safety filter that is positioned in inner cavity 108 of the filter support. The filtered air then passes through the safety filter and into the motor housing in a direction defined by air path P, as shown in FIG. 1.

Air is drawn through filter 80 by a fan 132 driven by a motor 134, both of which are positioned in the motor housing 130. The motor housing includes a lower inlet 136 and an air exhaust opening 138. The motor is typically an electric motor powered by 120 or 240V and causes fan 132 to rotate at about 10000–30000 RPM. The turning fan causes the air to flow through the low velocity chamber at about 20–100 CFM. The static suction produced by the rotating fan is about 40–150 inches plus the water lift. The motor rests on a vibration ring 140 to minimize noise and vibration during operation of the vacuum cleaner. As illustrated in FIG. 1, the motor housing includes an upper section 142 and a lower section 144. Several orientation slots and lock tab arrangements are used to connect the upper and lower sections together. A housing support 148 supports the motor housing on the top of the low velocity chamber. The end of the housing support forms a rim 150 that includes a seal slot 152 and a seal ring 154 positioned therein. As shown in FIG. 1, the end of filter 80 and filter liner 200 are secured between seal ring 154 on housing support 148 and seal ring 70 on the top of side wall 56. The seal formed between seal rings 70 and 154 at least partially inhibits or prevents air from bypassing filter 80 and filter liner 200, and from entering the motor housing when the motor housing is positioned on the top of canister 50.

As shown in FIG. 1, all the air entering lower inlet 136 is directed though air exhaust 138. In prior canister type vacuum cleaners, the air exhaust of the motor housing included a plurality of openings about the perimeter of the motor housing. Motor housing 130 alters this prior art exhaust air flow path by forcing the exhaust air through a single opening. It has been found that the flow rate of air through the vacuum cleaner is increased by this new exhaust air flow. After the exhaust air exits opening 138 of the motor housing, the exhausted air enters an expanding conduit 160. The first end 162 of the conduit telescopically receives a portion of a rim about opening 138, and a seal ring is positioned about the rim so as to direct most, if not all, of the exhausted air into the conduit. The conduit expands in size along the longitudinal length of the conduit. As shown in FIG. 1, the height of the inner passageway of the conduit increases along the longitudinal length of the conduit. The increase in height is caused by upper wall 168 remaining substantially planar and bottom wall 170 having an arcuate shape that curves downwardly. As can be appreciated, many other arrangements can be used to cause the height of the passageway to increase such as, but not limited to, the upper wall curving upwardly and the bottom wall remaining substantially planar, both the upper and lower walls curving away from one another, one or both walls being planar and angling away from one another, etc. The width of the inner passageway also increases along the longitudinal length of the conduit. The side walls 172 curve away from one another to cause the width of the conduit to increase. As can be appreciated, the width of the conduit, like the height, can be increased by use of other conduit configurations such as, but not limited to, side walls 172 curving outwardly. It has been found that by causing the size of the passageway to increase along the longitudinal length of the conduit, the throughput of air is increased. This is believed to be caused by venturi expansion effects. The combined use of the motor housing and expanding conduit have resulted in at least 5% and typically 10–40% greater efficiencies in air throughput.

The filtered air, upon exiting the conduit through the conduit second end 176, enters exhaust filter housing 180. The filter housing 180 includes a front and rear wall section 182, 184. The two sections are connected together by a plurality of screws; however, the two wall sections can be connected together by other means. The rear wall includes a slot used to connect the rear wall to the second end 176 of conduit 160. Support flanges 190, 192 are secured between the front and rear wall sections. The support flanges stabilize and secure the filter housing in vacuum cleaner housing 10.

Positioned in the filter chamber 194 and formed between the front and rear walls is a gas filter 200. The gas filter is designed to remove any noxious or undesired gases in the filtered exhausted air. The gas filter can take on a number of different forms so long as the exhausted air at least partially contacts one or more gas absorbing and/or adsorbing agents. Non-limiting forms of the gas filter include a granular and/or powered gas absorbing and/or adsorbing agent that is lacily piled up or formed in a rigid or semi-rigid shape, a granular and/or powered gas absorbing and/or adsorbing agent impregnated in a paper, matte and/or fabric material, etc. As can be appreciated, the gas filter can also be designed to filter out particles that still remain in the exhausted air. Although a gas filter is typically positioned in the filter housing, the gas filter can be substituted for a particle filter, if desired. In still another alternative, a scent agent can be positioned in the filter housing as an alterative to or in addition to one or more filters in the filter housing. The scent agent can be in the form of scented paper, a scented pad, a scented bar, scented granules, etc. The scent agent is used to mask odors exiting the vacuum cleaner and/or to provide a fresh or desired scent to the environment while the user is cleaning.

After the exhausted air has passed through the filter in the filter housing, the exhausted air is directed through a restricted opening 196 in front wall 182. A opening flange 198 is positioned about the opening and includes one or more ridges 199 that are designed to secure hose H to the opening when the user desires to use the vacuum cleaner as a blower. As shown in FIG. 1, opening 196 extends through an exit opening 14 in housing 10.

The procedures for changing the filters and filter liner in the housing will now be described. As shown in FIG. 1, housing 10 includes an upper section 22 and a base 30. Upper section 22 is designed to pivot about opening 12 so that the user can access and remove canister 50 from the interior of housing 10. Back support 24 on upper section 22 rests on base 30 when the housing sections are closed. When the user needs to open the housing, back support 24 is lifted off base 30 and continues to pivot the upper section about a pivot point near opening 12, not shown, until canister 50 is exposed. The lifting of upper section 22 causes the motor housing to be lifted off filter support 90 and off of filter 80 and filter liner 200. As can be appreciated, the upper section can be designed such that the upper section is completely lifted off the base of the housing instead of being pivoted to an opened position. Once the upper section 22 has been pivoted into the open position, the user grasps handle 66 on the canister and slides the canister off base 30. The canister is then moved to a location to remove dirt D from the base of the filter liner and to replace filter 80 and filter liner 200. During the replacement of the filters and the filter liner, filter 80 and filter liner 200 are lifted out of the canister and disposed of. The adhesive between the filter and the filter liner is typically designed to prevent the separation of the filter from the filter liner so as to minimize the amount of particles that escape during the disposal of the filter and the filter liner. The use of the filter liner also eliminates the need to carry the canister to a disposal site. As a result, the changing of the filter is made simpler and more convenient by the use of the filter liner.

Figure 8:
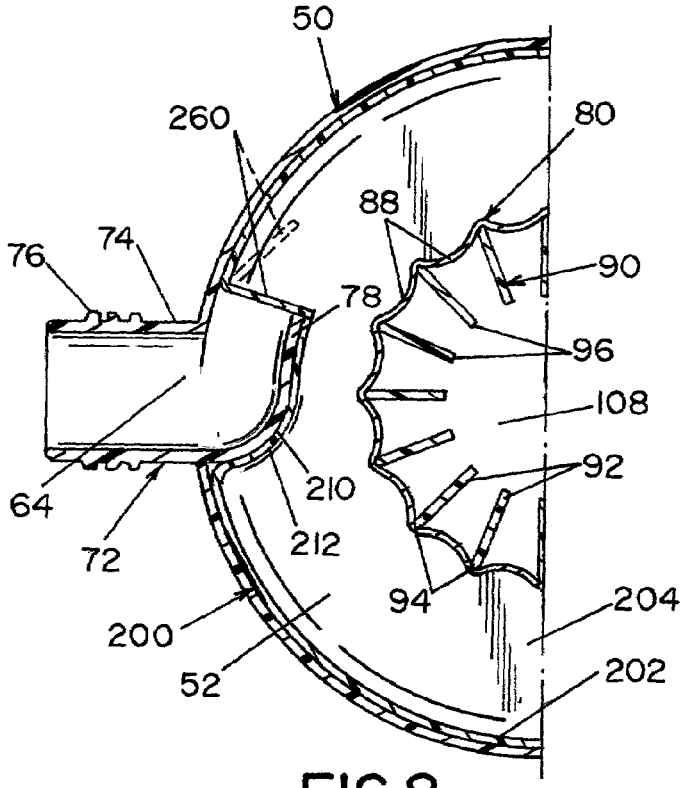
FIG. 8 is a partial top view of a filter arrangement positioned in a modified filter liner having a dust door.
Figure 9:
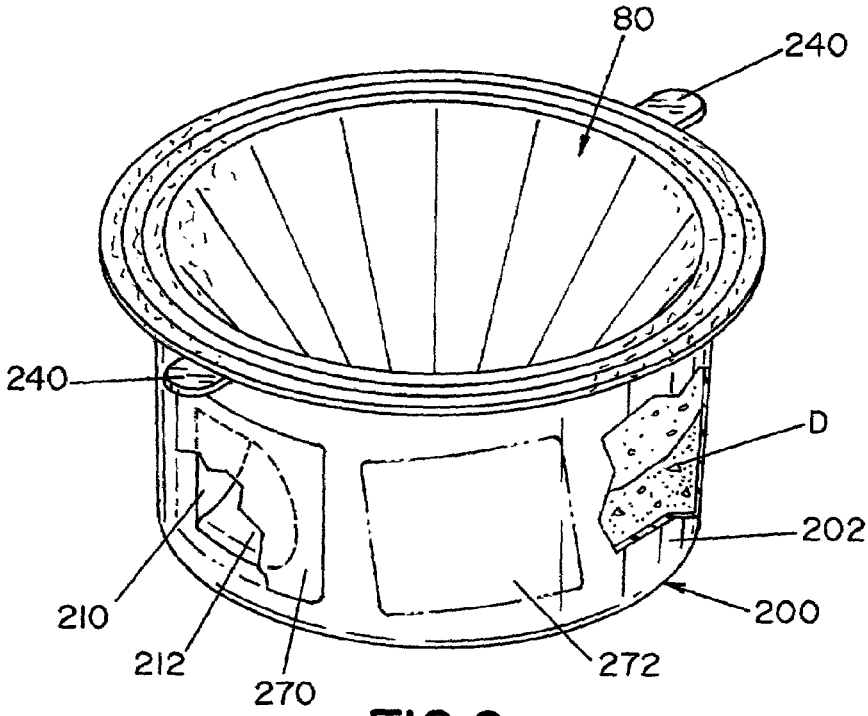
FIG. 9 is a perspective view of a used filter and modified filter liner connected together and removed from the low velocity chamber of the vacuum cleaner, which filter liner includes a sealing patch.

Referring now to FIGS. 8 and 9, two modifications to the filter liner are disclosed which are designed to further minimize the amount of particles that escape the filter liner during the changing of the dirty filter liner and filter. As shown in FIG. 8, the filter liner includes a dust door 260 connected to one side of the filter liner. The dust door is designed to at least partially close opening 210 during the removal of the filter liner from the canister. As can be appreciated, only a small amount of particles will escape the filter liner, as long as the filter remains connected to the filter liner. However, opening 210 can allow particles to spill through the opening during the changing of the filter liner and the filter. The dust door is designed to at least partially close the opening to thereby limit the amount of particles that spill from the opening. In one typical design, the dust door is biased in the closed position. During the operation of the vacuum cleaner, the dust door is drawn open by the vacuum inside the low velocity chamber. Once the vacuum cleaner is turned off, the dust door moves back to the closed position. As a result, when the filter liner is removed from the canister, the opening in the filter liner is partially or completely closed, thereby limiting the amount of particles that escape through the opening during the disposal of the filter and the filter liner.

Referring now to FIG. 9, the outside surface of the filter liner includes a sealing patch 270 that is removably connected a patch surface 272. As shown in FIG. 9, sealing patch 270 is designed to be applied over the opening in the side of the filter liner. By covering the opening, particles are inhibited or prevented from spilling out of the opening during the disposal of the filter liner and the filter. The sealing patch can include instructions on the face of the patch to provide information on when and/or how to use the sealing patch, and/or may contain other information a about the vacuum cleaner. The patch surface is positioned at a location away from the opening. The sealing patch typically includes an adhesive surface that adheres to a region about the opening in the filter liner. In this design, the patch surface typically includes a low-stick or nonstick surface that allows the seal patch to be removed from the patch surface and then inserted over the opening. As can be appreciated, the sealing patch can be used in conjunction with the dust door as discussed above.

Once the filter and filter liner are removed from the canister, a new filter and filter liner can be inserted into the canister. If the filter and filter liner are preconnected, the filter and filter liner are simultaneously inserted into the canister. If the filter liner and filter are separate, the filter liner is first placed in the canister and then the filter. If the filter liner includes a tape strip on the upper lip, the tape strip is removed prior to inserting the filter in the filter liner.

Figure 7:
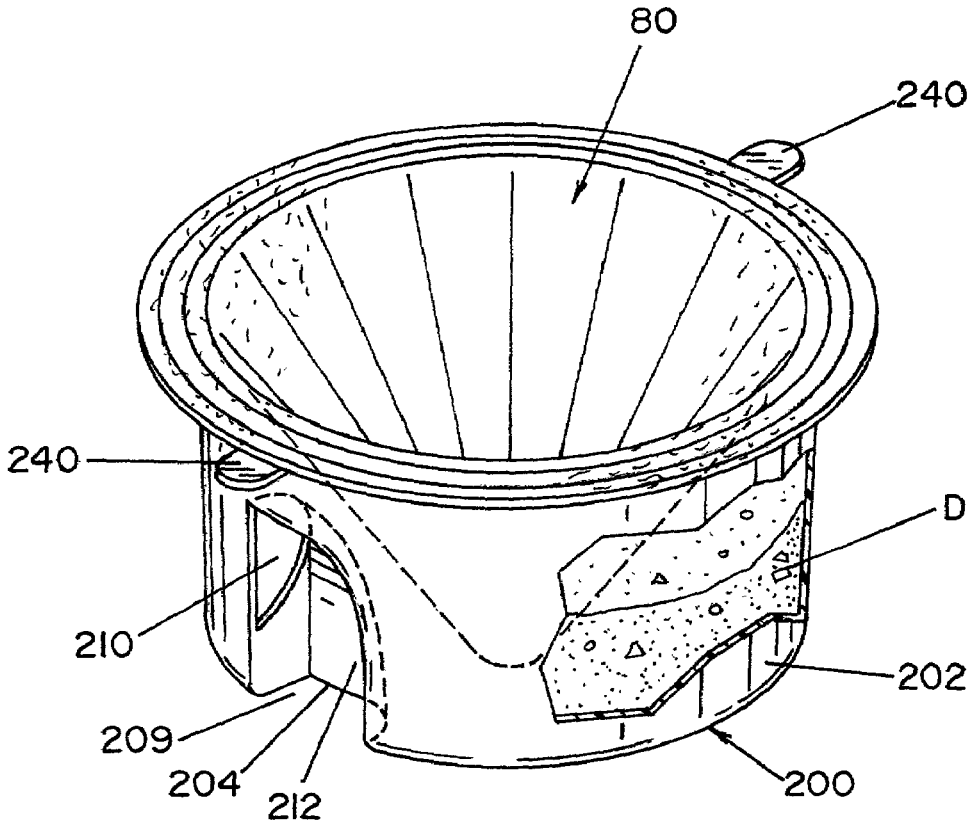
FIG. 7 is a perspective view of a used filter and filter liner connected together and removed from the low velocity chamber of the vacuum cleaner.

The operation of the novel filter arrangement will now be described. As shown in FIG. 6, a conical filter 80 is used to remove particles entrained in the air. Filter support 90 causes the filter to substantially retain its conical shape. The shape of filter 80 does become somewhat deformed when the vacuum cleaner is turned on. When motor 134 begins rotating fan blade 132 resulting in a vacuum being formed in low velocity chamber 52, filter 80 is drawn toward filter support 90. As best shown in FIG. 2, filter 80 is retained in position by the fin sections of the filter support, and is drawn inwardly between the regions of the fin sections, thereby creating a plurality of ribs 86 and trough portions 88 on the filter. The rib and trough portions of the deformed filter enhance the life and effectiveness of the filter. The advantages of the filter deformation will be described. As shown in FIG. 2, the air path about the filter is substantially tangential to the end of ribs 86. As a result, the particles in the air first contact the ribs of the filter prior to air passing through the trough portions. The ribs function as a barrier or accumulation point for the particles in the air, especially the large particles. Large particles D accumulate on the ribs of the filter and/or are stopped by the rib and fall to the base of the low velocity chamber. Since the ribs on the filter occupy a small area relative to the complete outer surface area of the filter, few particles can accumulate on the ribs. As a result, the large particles are knocked off or fall off the ribs and onto the base of the low velocity chamber, as shown in FIGS. 7 and 9. In addition, since the air velocity and air paths are different in the rib and trough portions, larger particles are less likely to adhere to the trough section of the filter as opposed to the ribs. Since most of the large to medium particles fall into the low velocity chamber, or accumulate on the limited regions of the ribs, the majority of the filter is able to filter out the smaller particles in the air as the air passes through the trough portions of the filter. Prior filter profiles equally exposed the complete outer filter surface to large and small particles in the air. As a result, the filter life was significantly reduced. It has been found that the self cleaning effects of the filter due to rib and trough section filter profile increase the filter life by at least 5%, and typically 10–25%.

The invention has been described with reference to a preferred embodiment and alternatives thereof. It is believed that many modifications and alterations to the embodiments disclosed will readily suggest themselves to those skilled in the art upon reading and understanding the detailed description of the invention. It is intended to include all such modifications and alterations insofar as they come within the scope of the present invention.

Having thus defined the invention, the following is claimed:

1. A vacuum cleaner comprising a low velocity chamber with a high velocity air inlet, a motor, a blade driven by said motor to create a vacuum in said chamber, an outlet for exhausting air from said chamber, said air flowing in a selected path from said air inlet, through said chamber and out said air exhaust outlet, the improvement comprising a filter and a filter liner positioned between said air inlet and said motor, said filter liner substantially made of a rigid, noncollapsible material, said filter liner and said filter at least partially connected together by an adhesive.

2. The vacuum cleaner as defined in claim 1, wherein said filter liner has substantially the same shape as the interior side of the low velocity chamber.

3. The vacuum cleaner as defined in claim 1, wherein said filter liner has substantially the same shape as the bottom surface of the low velocity chamber.

4. The vacuum cleaner as defined in claim 2, wherein said filter liner has substantially the same shape as the bottom surface of the low velocity chamber.

5. The vacuum cleaner as defined in claim 1, wherein said filter liner includes at least one tab positioned on an upper portion of said filter liner.

6. The vacuum cleaner as defined in claim 4, wherein said filter liner includes at least one tab positioned on an upper portion of said filter liner.

7. The vacuum cleaner as defined in claim 1, wherein said filter liner includes a sealing lip adapted to form a substantially air tight seal with said low velocity chamber.

8. The vacuum cleaner as defined in claim 5, wherein said filter liner includes a sealing lip adapted to form a substantially air tight seal with said low velocity chamber.

9. The vacuum cleaner as defined in claim 6, wherein said filter liner includes a sealing lip adapted to form a substantially air tight seal with said low velocity chamber.

10. The vacuum cleaner as defined in claim 7, wherein said sealing lip includes a sealing notch adapted to at least partially mate with a sealing ridge on said low velocity chamber.

11. The vacuum cleaner as defined in claim 8, wherein said sealing lip includes a sealing notch adapted to at least partially mate with a sealing ridge on said low velocity chamber.

12. The vacuum cleaner as defined in claim 9, wherein said sealing lip includes a sealing notch adapted to at least partially mate with a sealing ridge on said low velocity chamber.

13. The vacuum cleaner as defined in claim 1, wherein said filter liner includes an adhesive which forms a connection between said filter liner and said filter.

14. The vacuum cleaner as defined in claim 12, wherein said filter liner includes an adhesive which forms a connection between said filter liner and said filter.

15. The vacuum cleaner as defined in claim 13, wherein said adhesive is at least partially covered by a removable strip.

16. The vacuum cleaner as defined in claim 14, wherein said adhesive is at least partially covered by a removable strip.

17. The vacuum cleaner as defined in claim 13, wherein said adhesive is positioned on a sealing lip of said filter liner.

18. The vacuum cleaner as defined in claim 15, wherein said adhesive is positioned on a sealing lip of said filter liner.

19. The vacuum cleaner as defined in claim 16, wherein said adhesive is positioned on a sealing lip of said filter liner.

20. The vacuum cleaner as defined in claim 1, wherein said filter liner is substantially made of an air impermeable material.

21. The vacuum cleaner as defined in claim 19, wherein said filter liner is substantially made of an air impermeable material.

22. The vacuum cleaner as defined in claim 1, including a sealing patch adapted to be positioned over and seal an opening in a side of said filter liner.

23. The vacuum cleaner as defined in claim 21, including a sealing patch adapted to be positioned over and seal an opening in a side of said filter liner.

24. The vacuum cleaner as defined in claim 22, wherein said sealing patch is removably connected to a side of said filter liner.

25. The vacuum cleaner as defined in claim 23, wherein said sealing patch is removably connected to a side of said filter liner.

26. The vacuum cleaner as defined in claim 1, wherein said filter liner includes a dust door positioned in an opening in a side of said filter liner and biased in a closed position to substantially close said side opening.

27. The vacuum cleaner as defined in claim 21, wherein said filter liner includes a dust door positioned in an opening in a side of said filter liner and biased in a closed position to substantially close said side opening.

28. The vacuum cleaner as defined in claim 25, wherein said filter liner includes a dust door positioned in an opening in a side of said filter liner and biased in a closed position to substantially close said side opening.

29. The vacuum cleaner as defined in claim 28, wherein said low velocity chamber is contained in a removable canister that is removably positioned on a base of said vacuum cleaner.

30. The vacuum cleaner as defined in claim 27, wherein said low velocity chamber is contained in a movable canister that is removably positioned on a base of said vacuum cleaner.

31. The vacuum cleaner as defined in claim 1, wherein said filter liner includes a seal flange positioned on an outside surface of the filter liner and closely adjacent to a side opening in said filter liner.

32. A vacuum cleaner comprising a low velocity chamber with a high velocity air inlet, a motor, a blade driven by said motor to create a vacuum in said chamber, an outlet for exhausting air from said chamber, said air flowing in a selected path from said air inlet, through said chamber and out said air exhaust outlet, the improvement comprising a filter and a filter liner positioned between said air inlet and said motor, said filter liner substantially made of a rigid, noncollapsible material, said low velocity chamber is being contained in a removable canister that is removably positioned on a base of said vacuum cleaner.

33. A filter liner adapted for use in a low velocity chamber of a vacuum cleaner, said filter liner substantially made of a rigid, noncollapsible material and including an adhesive which forms a connection between said filter liner and a filter.

34. The filter liner as defined in claim 33, wherein said filter liner has substantially the same shape as the interior side of the low velocity chamber.

35. The filter liner as defined in claim 33, wherein said filter liner has substantially the same shape as the bottom surface of the low velocity chamber.

36. The filter liner as defined in claim 34, wherein said filter liner has substantially the same shape as the bottom surface of the low velocity chamber.

37. The filter liner as defined in claim 33, includes at least one tab positioned on an upper portion of said filter liner.

38. The filter liner as defined in claim 36, includes at least one tab positioned on an upper portion of said filter liner.

39. The filter liner as defined in claim 33, including a sealing lip adapted to form a substantially air tight seal with said low velocity chamber.

40. The filter liner as defined in claim 38, including a sealing lip adapted to form a substantially air tight seal with said low velocity chamber.

41. The filter liner as defined in claim 39, wherein said sealing lip includes a sealing notch adapted to at least partially mate with a sealing ridge on said low velocity chamber.

42. The filter liner as defined in claim 40, wherein said sealing lip includes a sealing notch adapted to at least partially mate with a sealing ridge on said low velocity chamber.

43. The filter liner as defined in claim 33, wherein said adhesive is at least partially covered by a removable strip.

44. The filter liner as defined in claim 42, wherein said adhesive is at least partially covered by a removable strip.

45. The filter liner as defined in claim 33, wherein said adhesive is positioned on a sealing lip of said filter liner.

46. The filter liner as defined in claim 43, wherein said adhesive is positioned on a sealing lip of said filter liner.

47. The filter liner as defined in claim 44, wherein said adhesive is positioned on a sealing lip of said filter liner.

48. The filter liner as defined in claim 33, wherein said filter liner is substantially made of an air impermeable material.

49. The filter liner as defined in claim 47, wherein said filter liner is substantially made of an air impermeable material.

50. The filter liner as defined in claim 49, including a sealing patch adapted to be positioned over and seal an opening in a side of said filter liner.

51. The filter liner as defined in claim 50, wherein said sealing patch is removably connected to a side of said filter liner.

52. The filter liner as defined in claim 49, including a dust door positioned in an opening in a side of said filter liner and biased in a closed position to substantially close said side opening.

53. The filter liner as defined in claim 51, including a dust door positioned in an opening in a side of said filter liner and biased in a closed position to substantially close said side opening.

54. The filter liner as defined in claim 33, including a seal flange positioned on an outside surface of the filter liner and closely adjacent to a side opening in said filter liner.

55. The filter liner as defined in claim 53, including a seal flange positioned on an outside surface of the filter liner and closely adjacent to a side opening in said filter liner.

56. A filter liner adapted for use in a low velocity chamber of a vacuum cleaner, said filter liner substantially made of a rigid, noncollapsible material and including a sealing patch adapted to be positioned over and seal an opening in a side of said filter liner.

57. The filter liner as defined in claim 56, wherein said sealing patch is removably connected to a side of said filter liner.

58. A filter liner adapted for use in a low velocity chamber of a vacuum cleaner, said filter liner substantially made of a rigid, noncollapsible material and including a dust door positioned in an opening in a side of said filter liner and biased in a closed position to substantially close said side opening.

59. A filter liner and filter combination adapted for use in a low velocity chamber of a vacuum cleaner, said filter liner substantially made of a rigid, noncollapsible material, said filter adapted to filter out a majority of particles entrained in air as the air passes through said filter, said filter liner and said filter at least partially connected together by an adhesive.

60. The combination as defined in claim 59, wherein said filter liner has substantially the same shape as the interior side of the low velocity chamber.

61. The combination as defined in claim 59, wherein said filter liner has substantially the same shape as the bottom surface of the low velocity chamber.

62. The combination as defined in claim 60, wherein said filter liner has substantially the same shape as the bottom surface of the low velocity chamber.

63. The combination as defined in claim 59, wherein said filter liner includes at least one tab positioned on an upper portion of said filter liner.

64. The combination as defined in claim 60, wherein said filter liner includes at least one tab positioned on an upper portion of said filter liner.

65. The combination as defined in claim 59, wherein said filter liner includes a sealing lip adapted to form a substantially air tight seal with said low velocity chamber.

66. The combination as defined in claim 64, wherein said filter liner includes a sealing lip adapted to form a substantially air tight seal with said low velocity chamber.

67. The combination as defined in claim 65, wherein said sealing lip includes a sealing notch adapted to at least partially mate with a sealing ridge on said low velocity chamber.

68. The combination as defined in claim 66, wherein said filter liner includes said adhesive which forms a connection between said filter liner and said filter.

69. The combination as defined in claim 68, wherein said adhesive is at least partially covered by a removable strip.

70. The combination as defined in claim 69, wherein said filter is connected to said filter liner by said adhesive after said removable strip is removed from said adhesive.

71. The combination as defined in claim 70, wherein said adhesive is positioned on a sealing lip of said filter liner.

72. The combination as defined in claim 59, wherein said filter liner is substantially made of an air impermeable material.

73. The combination as defined in claim 71, wherein said filter liner is substantially made of an air impermeable material.

74. The combination as defined in claim 73, including a sealing patch adapted to be-positioned over and seal an opening in a side of said filter liner.

75. The combination as defined in claim 74, wherein said sealing patch is removably connected to a side of said filter liner.

76. The combination as defined in claim 73, wherein said filter liner includes a dust door positioned in an opening in a side of said filter liner and biased in a closed position to substantially close said side opening.

77. The combination as defined in claim 59, wherein said filter liner includes a seal flange positioned on an outside surface of the filter liner and closely adjacent to a side opening in said filter liner.

78. The combination as defined in claim 73, wherein said filter liner includes a seal flange positioned on an outside surface of the filter liner and closely adjacent to a side opening in said filter liner.

79. A filter liner and filter combination adapted for use in a low velocity chamber of a vacuum cleaner, said filter liner substantially made of a rigid, noncollapsible material, said filter adapted to filter out a majority of particles entrained in air as the air passes through said filter, said filter liner including an adhesive which forms a connection between said filter liner and said filter, said adhesive is at least partially covered by a removable strip.

80. The combination as defined in claim 79, wherein said filter is connected to said filter liner by said adhesive after said removable strip is removed from said adhesive.

81. The combination as defined in claim 79, wherein said adhesive is positioned on a sealing lip of said filter liner.

82. The combination as defined in claim 80, wherein said adhesive is positioned on a sealing lip of said filter liner.

83. A filter liner and filter combination adapted for use in a low velocity chamber of a vacuum cleaner, said filter liner substantially made of a rigid, noncollapsible material, said filter adapted to filter out a majority of particles entrained in air as the air passes through said filter, a sealing patch adapted to be positioned over and seal an opening in a side of said filter liner.

84. The combination as defined in claim 83, wherein said sealing patch is removably connected to a side of said filter liner.

85. A filter liner and filter combination adapted for use in a low velocity chamber of a vacuum cleaner, said filter liner substantially made of a rigid, noncollapsible material, said filter adapted to filter out a majority of particles entrained in air as the air passes through said filter, said filter liner includes a dust door positioned in an opening in a side of said filter liner and biased in a closed position to substantially close said side opening.

* * * * *